US009399832B2

(12) United States Patent
Hall et al.

(10) Patent No.: US 9,399,832 B2
(45) **Date of Patent: *Jul. 26, 2016**

(54) STITCH DISTRIBUTION CONTROL SYSTEM FOR TUFTING MACHINES

(71) Applicant: Card-Monroe Corp., Chattanooga, TN (US)

(72) Inventors: Wilton Hall, Ringgold, GA (US); William M. Christman, Jr., Hixson, TN (US)

(73) Assignee: Card-Monroe Corp., Chattanooga, TN (US)

( * ) Notice: Subject to any disclaimer, the term of this patent is extended or adjusted under 35 U.S.C. 154(b) by 706 days.

This patent is subject to a terminal disclaimer.

(21) Appl. No.: 13/740,495

(22) Filed: Jan. 14, 2013

(65) Prior Publication Data

US 2013/0125801 A1 May 23, 2013

Related U.S. Application Data

(63) Continuation of application No. 12/495,016, filed on Jun. 30, 2009, now Pat. No. 8,359,989, which is a continuation-in-part of application No. 12/122,004, filed on May 16, 2008, now Pat. No. 8,141,505.

(Continued)

(51) Int. Cl.
*D05C 15/26* (2006.01)
*D05C 11/00* (2006.01)
(Continued)

(52) U.S. Cl.
CPC ..... *D05C 11/00* (2013.01); *D05C 15/18* (2013.01); *D05C 15/30* (2013.01); *D05C 15/34* (2013.01)

(58) Field of Classification Search
CPC ..... D05C 15/26; D05C 15/28; D05C 15/30; D05C 15/32; D05C 15/34; D05C 15/36
See application file for complete search history.

(56) References Cited

U.S. PATENT DOCUMENTS 2,811,244 A 10/1957 MacCaffray, Jr.
2,818,037 A 12/1957 McNutt
(Continued)

FOREIGN PATENT DOCUMENTS

EP 1474354 B1 7/2010
EP 2 100 994 B1 6/2011
(Continued)

OTHER PUBLICATIONS

Defendant Tuftco Corp.'s Amended Invalidity and Non-Infringement Contentions filed Dec. 9, 2015, *Card-Monroe Corp.* v. *Tuftco Corp.*, E.D. Tenn., Case No. 1:14-cv-292.
(Continued)

*Primary Examiner* — Nathan Durham
(74) *Attorney, Agent, or Firm* — Womble Carlyle Sandridge & Rice, LLP

(57) ABSTRACT

A stitch distribution control system for a tufting machine for controlling placement of yarns being fed to the needles of the tufting machine by yarn feed mechanisms to form a desired pattern. A backing material is fed through the tufting machine at an increased stitch rate as the needles are shifted according to calculated pattern steps. A series of loopers or hooks engage and pick loops of yarns from the needles. The yarn feed mechanisms further can be controlled so that selected loops of yarns can be back-robbed so as to be hidden from view in the finished patterned tufted article.

15 Claims, 19 Drawing Sheets

Related U.S. Application Data

(60) Provisional application No. 61/029,105, filed on Feb. 15, 2008, provisional application No. 61/077,499, filed on Jul. 2, 2008, provisional application No. 61/154,597, filed on Feb. 23, 2009, provisional application No. 61/184,993, filed on Jun. 8, 2009.

(51) Int. Cl.

| | |
|---|---|
| ***D05C 15/34*** | (2006.01) |
| ***D05C 15/18*** | (2006.01) |
| ***D05C 15/30*** | (2006.01) |

(56) References Cited

U.S. PATENT DOCUMENTS

| | | | |
|---|---|---|---|
| 2,840,019 | A | 6/1958 | Beasley |
| 2,842,259 | A | 7/1958 | Hoeselbarth |
| 2,866,424 | A | 12/1958 | Masland, II |
| 2,883,735 | A | 4/1959 | Hoeselbarth |
| 2,932,181 | A | 4/1960 | MacCaffray, Jr. |
| 2,965,054 | A | 12/1960 | Masland, II |
| 2,966,866 | A | 1/1961 | Card |
| 2,983,028 | A | 5/1961 | Cole |
| 2,990,792 | A | 7/1961 | Nowicki et al. |
| 2,991,738 | A | 7/1961 | Zenner et al. |
| 2,968,856 | A | 12/1961 | Allen |
| 3,016,029 | A | 1/1962 | Card |
| 3,026,029 | A | 1/1962 | Card |
| 3,026,830 | A | 3/1962 | Bryant et al. |
| 3,056,364 | A | 10/1962 | Dedmon |
| 3,067,701 | A | 12/1962 | Wilcox |
| 3,084,644 | A | 4/1963 | Card |
| 3,084,645 | A | 4/1963 | Card |
| 3,091,199 | A | 5/1963 | Ballard |
| 3,095,840 | A | 7/1963 | Ballard |
| 3,095,841 | A | 7/1963 | Ballard |
| 3,103,903 | A | 9/1963 | Broadrick et al. |
| 3,109,395 | A | 11/1963 | Batty et al. |
| 3,160,125 | A | 12/1964 | Bryant et al. |
| 3,162,155 | A | 12/1964 | Charles |
| 3,177,833 | A | 4/1965 | Passons |
| 3,202,379 | A | 8/1965 | Dedmon et al. |
| 3,203,388 | A | 8/1965 | Parlin et al. |
| 3,220,371 | A | 11/1965 | Short et al. |
| 3,259,088 | A | 7/1966 | Rockholt |
| 3,272,163 | A | 9/1966 | Erwin, Jr. et al. |
| 3,332,379 | A | 7/1967 | Cobble, Sr. et al. |
| 3,361,096 | A | 1/1968 | Watkins |
| 3,375,797 | A | 4/1968 | Gaines |
| 3,393,654 | A | 7/1968 | Barnes |
| 3,396,687 | A | 8/1968 | Nowicki |
| 3,433,188 | A | 3/1969 | Pickles |
| 3,435,787 | A | 4/1969 | Short |
| 3,485,195 | A | 12/1969 | Torrence |
| 3,490,399 | A | 1/1970 | Hesz |
| 3,547,058 | A | 12/1970 | Wembley et al. |
| 3,554,147 | A | 1/1971 | Spanel |
| 3,577,943 | A | 5/1971 | Watkins |
| 3,585,948 | A | 6/1971 | Cobble |
| 3,605,660 | A | 9/1971 | Short |
| 3,618,542 | A | 11/1971 | Zocher |
| 3,623,440 | A | 11/1971 | Spedding et al. |
| 3,662,697 | A | 5/1972 | Passons et al. |
| 3,670,672 | A | 6/1972 | Spanel |
| 3,688,804 | A | 9/1972 | Brown et al. |
| 3,701,464 | A | 10/1972 | Crum |
| 3,709,173 | A | 1/1973 | Greene |
| 3,752,094 | A | 8/1973 | Short |
| 3,752,095 | A | 8/1973 | Brown et al. |
| 3,757,709 | A | 9/1973 | Cobble |
| 3,812,799 | A | 5/1974 | Spanel et al. |
| 3,824,939 | A | 7/1974 | Spanel et al. |
| 3,835,797 | A | 9/1974 | Franks et al. |
| 3,842,767 | A | 10/1974 | Short |
| 3,847,098 | A | 11/1974 | Hammel, Jr. |
| 3,865,059 | A | 2/1975 | Jackson |
| 3,875,883 | A | 4/1975 | Eberwein et al. |
| 3,881,432 | A | 5/1975 | Dodd et al. |
| 3,908,881 | A | 9/1975 | McCann |
| 3,919,953 | A | 11/1975 | Card et al. |
| 3,934,524 | A | 1/1976 | Smith |
| 3,937,156 | A | 2/1976 | Spanel |
| 3,937,157 | A | 2/1976 | Spanel et al. |
| 3,937,158 | A | 2/1976 | Spanel |
| 3,937,159 | A | 2/1976 | Spanel |
| 3,937,160 | A | 2/1976 | Spanel et al. |
| 3,943,865 | A | 3/1976 | Short et al. |
| 3,972,295 | A | 8/1976 | Smith |
| 3,978,800 | A | 9/1976 | Card et al. |
| 3,982,491 | A | 9/1976 | Herzer et al. |
| 4,015,550 | A | 4/1977 | Bartenfeld et al. |
| 4,029,030 | A | 6/1977 | Smith |
| 4,047,491 | A | 9/1977 | Spanel et al. |
| 4,048,930 | A | 9/1977 | Card |
| 4,064,816 | A | 12/1977 | Spanel et al. |
| 4,089,281 | A | 5/1978 | Landoni |
| 4,100,863 | A | 7/1978 | Shortte, Jr. |
| 4,103,629 | A | 8/1978 | Card |
| 4,106,416 | A | 8/1978 | Blackstone, Jr. et al. |
| 4,119,047 | A | 10/1978 | Spanel et al. |
| 4,127,078 | A | 11/1978 | Spanel et al. |
| 4,134,347 | A | 1/1979 | Jolley et al. |
| 4,134,348 | A | 1/1979 | Scott |
| 4,138,956 | A | 2/1979 | Parsons |
| 4,154,176 | A | 5/1979 | Spanel et al. |
| 4,155,319 | A | 5/1979 | Short |
| 4,170,949 | A | 10/1979 | Lund |
| 4,173,192 | A | 11/1979 | Schmidt et al. |
| 4,185,569 | A | 1/1980 | Inman |
| 4,193,358 | A | 3/1980 | Woodcock |
| 4,195,580 | A | 4/1980 | Hurst |
| 4,221,317 | A | 9/1980 | Fukada et al. |
| 4,224,884 | A | 9/1980 | Shortte, Jr. |
| 4,241,675 | A | 12/1980 | Bardsley |
| 4,241,676 | A | 12/1980 | Parsons et al. |
| 4,244,309 | A | 1/1981 | Spanel et al. |
| 4,245,794 | A | 1/1981 | Hasegawa et al. |
| 4,254,718 | A | 3/1981 | Spanel et al. |
| 4,255,050 | A | 3/1981 | Beckstein et al. |
| 4,261,498 | A | 4/1981 | Short |
| 4,267,787 | A | 5/1981 | Fukuda |
| 4,303,024 | A | 12/1981 | Bardsley |
| 4,303,189 | A | 12/1981 | Wiley et al. |
| 4,313,388 | A | 2/1982 | Biggs et al. |
| 4,317,419 | A | 3/1982 | Spanel et al. |
| 4,320,711 | A | 3/1982 | Slattery |
| 4,353,317 | A | 10/1982 | Crumbliss |
| 4,365,565 | A | 12/1982 | Kawai et al. |
| 4,366,761 | A | 1/1983 | Card |
| 4,369,720 | A | 1/1983 | Beasley |
| 4,370,937 | A | 2/1983 | Denny |
| 4,384,538 | A | 5/1983 | Slattery |
| 4,393,793 | A | 7/1983 | Beasley |
| 4,397,249 | A | 8/1983 | Slattery |
| 4,399,758 | A | 8/1983 | Bagnall |
| 4,401,024 | A | 8/1983 | Frentress |
| 4,419,944 | A | 12/1983 | Passons et al. |
| 4,429,648 | A | 2/1984 | Slattery |
| 4,440,102 | A | 4/1984 | Card et al. |
| 4,445,447 | A | 5/1984 | Bardsley et al. |
| 4,448,137 | A | 5/1984 | Curtis et al. |
| 4,466,366 | A | 8/1984 | Hirotsu |
| 4,469,037 | A | 9/1984 | Bost, Jr. |
| 4,483,260 | A | 11/1984 | Gallant |
| 4,501,212 | A | 2/1985 | Slattery |
| 4,519,332 | A | 5/1985 | Fukuda |
| 4,522,132 | A | 6/1985 | Slattery |
| 4,528,921 | A | 7/1985 | Slattery |
| 4,531,465 | A | 7/1985 | Hampton |
| 4,548,140 | A | 10/1985 | Price et al. |
| 4,549,496 | A | 10/1985 | Kile |
| 4,557,208 | A | 12/1985 | Ingram et al. |
| 4,574,716 | A | 3/1986 | Czelusniak, Jr. |
| 4,586,445 | A | 5/1986 | Card et al. |

(56) References Cited

U.S. PATENT DOCUMENTS

| | | | |
|---|---|---|---|
| 4,597,344 | A | 7/1986 | Stutznacker |
| 4,608,935 | A | 9/1986 | Bardsley |
| 4,619,212 | A | 10/1986 | Card et al. |
| 4,630,558 | A | 12/1986 | Card et al. |
| 4,637,329 | A | 1/1987 | Czelusniak, Jr. |
| 4,653,293 | A | 3/1987 | Porat |
| 4,653,413 | A | 3/1987 | Bagnall |
| 4,665,845 | A | 5/1987 | Card et al. |
| 4,667,611 | A | 5/1987 | Yamamoto et al. |
| 4,669,171 | A | 6/1987 | Card et al. |
| 4,682,554 | A | 7/1987 | Goto et al. |
| 4,686,918 | A | 8/1987 | Hjalmer et al. |
| 4,688,497 | A | 8/1987 | Card et al. |
| 4,693,190 | A | 9/1987 | Slattery |
| D293,323 | S | 12/1987 | Slattery et al. |
| 4,726,306 | A | 2/1988 | Crumbliss |
| 4,741,000 | A | 4/1988 | Fukuda |
| 4,786,177 | A | 11/1988 | Beckstein et al. |
| 4,790,252 | A | 12/1988 | Bardsley |
| 4,794,874 | A | 1/1989 | Slattery |
| 4,815,401 | A | 3/1989 | Bagnall |
| 4,815,402 | A | 3/1989 | Price |
| 4,815,403 | A | 3/1989 | Card et al. |
| 4,817,541 | A | 4/1989 | Magourik |
| 4,829,917 | A | 5/1989 | Morgante et al. |
| 4,831,948 | A | 5/1989 | Itoh et al. |
| 4,836,118 | A | 6/1989 | Card et al. |
| 4,841,886 | A | 6/1989 | Watkins |
| 4,849,270 | A | 7/1989 | Evans et al. |
| 4,852,505 | A | 8/1989 | Dedmon |
| 4,856,441 | A | 8/1989 | Kurata |
| 4,860,674 | A | 8/1989 | Slattery |
| 4,864,946 | A | 9/1989 | Watkins |
| 4,867,080 | A | 9/1989 | Taylor et al. |
| 4,870,915 | A | 10/1989 | Bagnall |
| 4,890,924 | A | 1/1990 | Beckstein |
| 4,903,624 | A | 2/1990 | Card et al. |
| 4,903,625 | A | 2/1990 | Card et al. |
| 4,981,091 | A | 1/1991 | Taylor et al. |
| 4,991,523 | A | 2/1991 | Ingram |
| 5,005,498 | A | 4/1991 | Taylor et al. |
| 5,035,030 | A | 7/1991 | Pellari |
| 5,058,518 | A | 10/1991 | Card et al. |
| 5,080,028 | A | 1/1992 | Ingram |
| 5,094,178 | A | 3/1992 | Watkins |
| 5,143,003 | A | 9/1992 | Dedmon |
| 5,158,027 | A | 10/1992 | Ingram |
| 5,165,352 | A | 11/1992 | Ingram |
| 5,182,997 | A | 2/1993 | Bardsley |
| 5,189,966 | A | 3/1993 | Satterfield |
| 5,205,233 | A | 4/1993 | Ingram |
| 5,224,434 | A | 7/1993 | Card et al. |
| 5,267,520 | A | 12/1993 | Ingram |
| 5,295,450 | A | 3/1994 | Neely |
| 5,383,415 | A | 1/1995 | Padgett, III |
| 5,392,723 | A | 2/1995 | Kaju |
| 5,400,727 | A | 3/1995 | Neely |
| 5,413,832 | A | 5/1995 | Willey |
| 5,416,593 | A | 5/1995 | Cercruysse |
| 5,458,075 | A | 10/1995 | Tice et al. |
| 5,461,996 | A | 10/1995 | Kaju |
| 5,480,085 | A | 1/1996 | Smithe et al. |
| 5,484,639 | A | 1/1996 | Woodall et al. |
| 5,491,372 | A | 2/1996 | Erhart |
| 5,495,815 | A | 3/1996 | Bagnall |
| 5,499,588 | A | 3/1996 | Card et al. |
| 5,501,250 | A | 3/1996 | Edwards et al. |
| 5,503,096 | A | 4/1996 | Willey |
| 5,509,364 | A | 4/1996 | Bardsley |
| 5,513,586 | A | 5/1996 | Neely et al. |
| 5,526,760 | A | 6/1996 | Ok |
| 5,529,002 | A | 6/1996 | Piller |
| 5,544,605 | A | 8/1996 | Frost |
| 5,549,064 | A | 8/1996 | Padgett, III |
| 5,557,154 | A | 9/1996 | Erhart |
| 5,562,056 | A | 10/1996 | Christman, Jr. |
| 5,566,629 | A | 10/1996 | Satterfield |
| 5,566,630 | A | 10/1996 | Burgess et al. |
| 5,575,228 | A | 11/1996 | Padgett, III et al. |
| 5,588,383 | A | 12/1996 | Davis et al. |
| 5,622,126 | A | 4/1997 | Card et al. |
| 5,653,184 | A | 8/1997 | Bardsley |
| 5,662,054 | A | 9/1997 | Bardsley |
| 5,706,744 | A | 1/1998 | Card et al. |
| 5,706,745 | A | 1/1998 | Neely et al. |
| 5,738,030 | A | 4/1998 | Ok |
| 5,743,200 | A | 4/1998 | Miller et al. |
| 5,743,201 | A | 4/1998 | Card et al. |
| 5,794,551 | A | 8/1998 | Morrison et al. |
| 5,806,446 | A | 9/1998 | Morrison et al. |
| 5,809,917 | A | 9/1998 | McGowan et al. |
| 5,896,821 | A | 4/1999 | Neely et al. |
| 5,899,152 | A | 5/1999 | Bardsley et al. |
| 5,954,003 | A | 9/1999 | Beyer et al. |
| 5,974,991 | A | 11/1999 | Bardsley |
| 5,979,344 | A | 11/1999 | Christman, Jr. |
| 5,983,815 | A | 11/1999 | Card |
| 5,989,368 | A | 11/1999 | Tillander et al. |
| 6,009,818 | A | 1/2000 | Card et al. |
| 6,155,187 | A | 12/2000 | Bennett et al. |
| 6,196,145 | B1 | 3/2001 | Burgess |
| 6,202,580 | B1 | 3/2001 | Samilo |
| 6,213,036 | B1 | 4/2001 | Slattery |
| 6,224,203 | B1 | 5/2001 | Wotton et al. |
| 6,228,460 | B1 | 5/2001 | Hamilton et al. |
| 6,230,638 | B1 | 5/2001 | Ownbey et al. |
| 6,244,203 | B1 | 6/2001 | Morgante et al. |
| 6,263,811 | B1 | 7/2001 | Crossley |
| 6,273,011 | B1 | 8/2001 | Amos |
| 6,283,053 | B1 | 9/2001 | Morgante et al. |
| 6,293,211 | B1 | 9/2001 | Samilo |
| 6,401,639 | B1 | 6/2002 | Samilo |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,651,571 | B2 | 11/2003 | Bennett et al. |
| 6,729,254 | B2 | 5/2004 | Mamiya |
| 6,758,154 | B2 | 7/2004 | Johnston |
| 6,776,109 | B2 | 8/2004 | Segars et al. |
| 6,782,838 | B1 | 8/2004 | Segars et al. |
| 6,807,917 | B1 | 10/2004 | Christman et al. |
| 6,823,900 | B2 | 11/2004 | Wildeman et al. |
| 6,827,030 | B2 | 12/2004 | Hicks |
| 6,834,601 | B2 | 12/2004 | Card et al. |
| 6,834,602 | B1 | 12/2004 | Hall |
| 6,877,447 | B2 | 4/2005 | Frost et al. |
| 6,877,449 | B2 | 4/2005 | Morgante et al. |
| 6,895,877 | B1 | 5/2005 | Weiner |
| 6,902,789 | B2 | 6/2005 | Funasako |
| 6,945,184 | B2 | 9/2005 | Frost et al. |
| 6,971,326 | B1 | 12/2005 | Clarke et al. |
| 7,007,617 | B2 | 3/2006 | Johnston |
| 7,033,661 | B2 | 4/2006 | Whitten et al. |
| 7,083,841 | B2 | 8/2006 | Oakey et al. |
| 7,089,874 | B2 | 8/2006 | Morgante et al. |
| 7,096,806 | B2 | 8/2006 | Card et al. |
| 7,130,711 | B2 | 10/2006 | Dabrowa et al. |
| 7,216,598 | B1 | 5/2007 | Christman, Jr. |
| 7,222,576 | B2 | 5/2007 | Kilgore |
| 7,237,497 | B2 | 7/2007 | Johnston |
| 7,243,513 | B2 | 7/2007 | Kohlman |
| 7,264,854 | B2 | 9/2007 | Stroppiana |
| 7,296,524 | B2 | 11/2007 | Beverly |
| 7,333,877 | B2 | 2/2008 | Dabrowa et al. |
| 7,347,151 | B1 | 3/2008 | Johnston et al. |
| RE40,194 | E | 4/2008 | Slattery |
| 7,350,443 | B2 | 4/2008 | Oakey et al. |
| 7,356,453 | B2 | 4/2008 | Gould |
| 7,426,895 | B2 | 9/2008 | Smith et al. |
| 7,431,974 | B2 | 10/2008 | Lovelady et al. |
| 7,438,007 | B1 | 10/2008 | Hall |

(56) References Cited

U.S. PATENT DOCUMENTS

| | | | |
|---|---|---|---|
| 7,490,566 | B2 | 2/2009 | Hall |
| 7,490,569 | B2 | 2/2009 | Whitten et al. |
| 7,634,326 | B2 | 12/2009 | Christman, Jr. et al. |
| 7,682,686 | B2 | 3/2010 | Curro et al. |
| 7,685,952 | B2 | 3/2010 | Frost et al. |
| 7,707,953 | B2 | 5/2010 | Hillenbrand et al. |
| 7,717,049 | B2 | 5/2010 | Hillenbrand et al. |
| 7,717,051 | B1 | 5/2010 | Hall et al. |
| 7,814,850 | B2 | 10/2010 | Bearden |
| 8,082,861 | B2 | 12/2011 | Lovelady et al. |
| 8,127,698 | B1 | 3/2012 | Ingram |
| 8,141,505 | B2 | 3/2012 | Hall et al. |
| 8,240,263 | B1 | 8/2012 | Frost et al. |
| 8,359,989 | B2 | 1/2013 | Hall et al. |
| 8,776,703 | B2 | 7/2014 | Hall et al. |
| 2002/0037388 | A1 | 3/2002 | Morgante et al. |
| 2002/0067483 | A1 | 6/2002 | Lacovara |
| 2003/0164130 | A1 | 9/2003 | Morgante et al. |
| 2004/0025767 | A1 | 2/2004 | Card et al. |
| 2004/0187268 | A1 | 9/2004 | Johnston |
| 2004/0253409 | A1 | 12/2004 | Whitten et al. |
| 2005/0056197 | A1 | 3/2005 | Card et al. |
| 2005/0109253 | A1 | 5/2005 | Johnston |
| 2005/0188905 | A1 | 9/2005 | Dabrawa et al. |
| 2005/0204975 | A1 | 9/2005 | Card et al. |
| 2006/0272564 | A1 | 12/2006 | Card et al. |
| 2007/0272137 | A1 | 11/2007 | Christman et al. |
| 2008/0134949 | A1 | 6/2008 | Bearden |
| 2009/0205547 | A1 | 8/2009 | Hall |

FOREIGN PATENT DOCUMENTS

| | | | |
|---|---|---|---|
| GB | 853943 | | 11/1960 |
| GB | 859761 | | 1/1961 |
| GB | 920023 | | 3/1963 |
| GB | 1039857 | | 8/1966 |
| GB | 2050447 | A | 7/1981 |
| GB | 2115025 | A | 9/1983 |
| GB | 2246371 | A | 1/1992 |
| GB | 2319786 | A | 6/1998 |
| GB | 2392172 | A | 2/2004 |
| GB | 2 385 604 | B | 3/2005 |
| GB | 2385604 | B | 3/2005 |
| GB | 2446371 | | 8/2008 |
| JP | 6-83787 | | 2/1991 |
| JP | 03-294561 | | 12/1991 |
| JP | 683787 | | 2/1992 |
| JP | 08-003859 | | 1/1996 |
| JP | 8003859 | A | 9/1996 |
| JP | 2005240199 | | 9/2005 |
| JP | 2006-524753 | | 11/2006 |
| WO | WO84/00388 | | 2/1984 |
| WO | WO94/28225 | | 5/1994 |
| WO | WO96/12843 | | 5/1996 |
| WO | WO01/59195 | | 8/2001 |
| WO | WO 2004/057084 | | 7/2004 |
| WO | WO2004/057084 | | 8/2004 |
| WO | WO 2006/076558 | | 7/2006 |
| WO | WO2006096558 | | 7/2006 |

OTHER PUBLICATIONS

Extended European Search Report for related European application No. 14167506.4-1710/2775023, dated Nov. 9, 2015.

Office Action dated Dec. 27, 2013 for related Japanese Application No. 2013-024279.

Search report for related application, PCT International Search Report, application No. PCT/US2008/080946, filed Oct. 23, 2008.

CAN with Encore DMC, Operator's Manual, Version 3.6, Tuftco Corporation, Copyright 1995, Chattanooga, TN.

Command Performance 200 Instruction Manual, Version 3.12, CMC #801107-01, Card-Monroe Corp., Copyright 1985-1994, Chattanooga, TN.

Tuft Program, Version 1.20, Nov. 1993, NedGraphics BV.

CMC Yarntronics Brochure, http://www.cardmonroe.com/Products/Yarntronics/yarnt.htm, printed Feb. 21, 2002.

Automation Comes To Paris, Carpet & Rug, Inc., 1987.

Moving Toward Total Automation, Carpet & Rug Industry, Dec. 1990.

International Search Report and Written Opinion for Application No. PCT/US2008/081527, mailed Feb. 18, 2009.

Search report for related application, International Search Report, application No. PCT/US2009/049501, filed Feb. 7, 2009.

Extended European Search Report dated Aug. 7, 2009, European Patent Application No. 09 152 848 .9 (Pub No. 2 100 994).

European Official Communication dated Mar. 25, 2010, European Patent Application No. 09 152 848 .9 (Pub No. 2 100 994).

European Notice of Intention to Grant a European Patent dated Dec. 13, 2010, European Patent Application No. 09 152 848 9 (Pub No. 2 100 994).

Response submitted Sep. 30, 2010, to the Communication dated Mar. 25, 2010, European Patent Application No. 09 152 848 9 (Pub No. 2 100 994).

Carpet Design, Technology Are on a Roll, Kathryn Sellers, Carpet & Rug Institute, ©2001, Textile World, vol. 151, No. 3.

NedGraphics, Aug. 26, 1994, Carpet & Floor Coverings Review.

Simple or sophisticated: Computers: CAD, Sep. 11, 1992, Carpet & Floor Coverings Review, pp. 32-34.

Partial European Search Report for EP 14 16 7507 dated Mar. 18, 2015.

Partial European Search Report for EP 09 15 2848 dated Aug. 7, 2009.

Cobble, Blackburn Ltd., Servo Systems Operation Manual—New Software Version—Apr. 1999, Issue 2.11A—pp. 1-16.

Cobble, ST (with Graphical User Interface) Tufting Machine—Operator's Handbook—Revision 1.5, Software Build 43—Issue Date: Sep. 2003.

Office Action for JP 2013-211615, mailed Aug. 22, 2014, with English translation.

Defendant Tuftco Corp.'s Motion to Stay Case Pending Determination of *Inter Partes* Review Proceedings, filed Dec. 29, 2014, *Card-Monroe Corp.*, v. *Tuftco Corp.*, E.D. Tenn., Case No. 1:14-cv-292.

Defendant Tuftco Corp.'s Memorandum in Support of Motion to Stay Case Pending Determination of *Inter Partes* Review Proceedings, filed Dec. 29, 2014, *Card-Monroe Corp.*, v. *Tuftco Corp.*, E.D. Tenn., Case No. 1:14-cv-292.

Plaintiff's Motion to Dismiss Defendant's Amended Counterclaims and to Strike Portions of Defendant's Affirmative Defenses, filed Jan. 22, 2015, *Card-Monroe Corp.*, v. *Tuftco Corp.*, E.D. Tenn., Case No. 1:14-cv-292.

Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit A to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit B to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit C to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit D to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit E to Plaintiffs Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit F to Plaintiff's Memorandum of Law in Support of Motion to Dismiss Defendant's Amended Counterclaims and to Strike Portions

(56) References Cited

OTHER PUBLICATIONS of Defendant's Affirmative Defenses, Filed Jan. 22, 2015, *Card-Monroe Corp.*, v. *Tuftco Corp.*, E.D. Tenn., Case No. 1:14-cv-292.
Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, Ed. Tenn., Case No. 1:14-cv-292.
Exhibit A to Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, E.D. Tenn., Case No. 1:14-cv-292.
Exhibit B to Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, E.D. Tenn., Case No. 1:14-cv-292.
Exhibit C to Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, E.D. Tenn., Case No. 1:14-cv-292.
Exhibit D to Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, E.D. Tenn., Case No. 1:14-cv-292.
Exhibit E to Plaintiff's Response in Opposition to Defendant's Motion to Stay Case Pending Determination of *Inter Partes* Review Proceeding, Filed Jan. 22, 2015, *Card-Monroe Corp.*, v. *Tuftco Corp.*, E.D. Tenn., Case No. 1:14-cv-292.
Order, Filed Jan. 23, 2015, *Card-Monroe Corp.*, v. *Tuftco Corp.*, E.D. Tenn., Case No. 1:14-cv-292.
Plaintiff's Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit a to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit B to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit C to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit D to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit E to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit F to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Defendant Tufco Corp.'s Reply in Support of Motion to Stay Case Pending Determination of *Inter Partes* Review Proceedings, Filed Jan. 29, 2015, *Card-Monroe Corp.*, v. *Tuftco Corp.*, E.D. Tenn., Case No. 1:14-cv-292.
Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit A to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit B to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit C to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Order, Filed Feb. 19, 2015, *Card-Monroe Corp.*, v. *Tuftco Corp.*, E.D. Tenn., Case No. 1:14-cv-292.
Plaintiff's Reply Memorandum of Law in Support of Motion to Dismiss Defendant's Amended Counterclaims and to Strike Portions of Defendant's Affirmative Defenses, Field Feb. 26, 2015, *Card-Monroe Corp.*, v. *Tuftco Corp.*, E.D. Tenn., Case No. 1:14-cv-292.
Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit A to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit B to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit C to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit D to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit E to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit F to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit G to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit H to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit I to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
English translation of Japanese Office Action mailed Mar. 4, 2013, for related application No. JP2009-032036.
Decision Denying Institution of Inter Partes Review entered Jul. 22, 2015.
Communication re: Notice of Opposition (and Exhibits included therewith) filed Mar. 12, 2015 against EP2321454.
Japanese Office Action for related Japanese Application No. 2011-51516872, mailing date Dec. 3, 2012—with Translation.
Defendant's Opening Claim Construction Brief.
Plaintiff's Opening Claim Construction Brief.
Exhibit J—Lexmark Glossary—CMC Claim Construction Brief.
Exhibit L—Declaration of Steven Berger—CMC Claim Construction Brief.
Plaintiffs Responsive Claim Construction Brief.
Defendant's Responsive Claim Construction Brief.
EPO—Response to Opposition—EP Patent 2 321 454.
Third Office Action—Chinese Text—CN 201210371253.0.
English translation of the Chinese Office Action—CN 201210371253.0.
Defendant Tuftco Corp.'s Answer and Amended Counterclaim, filed Jan. 8, 2015, in matter of *Card-Monroe Corp*, Plaintiff. v. *Tuftco Corp.*, Defendant—Case No. 1:14-cv-292, before Judge Mattice, Magistrate Judge Carter.

(56) References Cited

OTHER PUBLICATIONS

Plaintiff's Memorandum of Law in Support of Motion to Dismiss Defendant's Counterclaims and to Strike Defendant's Fourth Through Seventh and Ninth Affirmative Defenses, filed Dec. 15, 2014, in matter of *Card-Monroe Corp*, Plaintiff. v. *Tuftco Corp.*, Defendant—Case No. 1:14-cv-292, before Judge Mattice, Magistrate Judge Carter.

Defendant Tuftco's Response Brief to Plaintiff Card-Monroe's Motion to Dismiss and Motion to Strike, filed Jan. 15, 2015, in matter of *Card-Monroe Corp*, Plaintiff. v. *Tuftco Corp.*, Defendant—Case No. 1:14-cv-292, before Judge Mattice, Magistrate Judge Carter.

Petition for *Inter Partes* Review Under 35 USC §§ 311-319 and CFR § 42.100 et seq, filed in Patent Trial and Appeal Board in the matter of *Tuftco Corp*. v. *Card-Monroe Corp*. on Dec. 24, 2014, *Inter Partes* Review No. IPR2015-00505.

Declaration of Ian Slattery filed in connection with Inter Partes Review No. IPR2015-00505.

Cobble Tufting Machine Company, Inc. ColorTec Operating and Maintenance Manual Servotec Software Version 3.10.xx Apr. 2005.

Spare Parts Manual ColorTec, dated May 8, 1998.

Windows PCCI Operator's Manual, Version 1.0, dated Mar. 13, 1998.

Defendant Tuftco Corp.'s Answer and Counterclaim, filed Nov. 24, 2014, in matter of *Card-Monroe Corp*, Plaintiff. v. *Tuftco Corp.*, Defendant—Case No. 1:14-cv-292, before Judge Mattice, Magistrate Judge Carter.

Three Colors

Four Colors

Five Colors

Six Colors

STITCH DISTRIBUTION CONTROL SYSTEM FOR TUFTING MACHINES

CROSS REFERENCE TO RELATED APPLICATIONS

This application is a continuation of U.S. application Ser. No. 12/495,016, entitled STITCH DISTRIBUTION CONTROL SYSTEM FOR TUFTING MACHINES, filed Jun. 30, 2009, which application is a continuation-in-part of U.S. patent application Ser. No. 12/122,004, entitled YARN COLOR PLACEMENT SYSTEM, filed May 16, 2008, which claims the benefit of U.S. Provisional Application Ser. No. 61/029,105, entitled YARN COLOR PLACEMENT SYSTEM, filed Feb. 15, 2008, and further claims the benefit of U.S. Provisional Application Ser. No. 61/077,499 entitled COLOR DISTRIBUTION CONTROL SYSTEM FOR TUFTING MACHINES, filed Jul. 2, 2008, of U.S. Provisional Application Ser. No. 61/154,597, entitled STITCH DISTRIBUTION CONTROL SYSTEM FOR TUFTING MACHINES, filed Feb. 23, 2009, and of U.S. Provisional Application Ser. No. 61/184,993, entitled LEVEL CUT LOOP LOOPER AND CLIP ASSEMBLY, filed Jun. 8, 2009, each of the listed applications being incorporated herein by reference in its entirety.

FIELD OF THE INVENTION

The present invention generally relates to tufting machines, and in particular, to a system for controlling the feeding and placement of individual yarns or stitches, including desired placement of yarns of various different colors, piles, and/or heights within a backing material passing through a tufting machine to enable formation of free-flowing patterns within a tufted article.

BACKGROUND OF THE INVENTION

In the tufting of carpets and other, similar articles, there is considerable emphasis placed upon development of new, more eye-catching patterns in order to try to keep up with changing consumer tastes and increased competition in the marketplace. In particular, there has been emphasis over the years on the formation of carpets that replicate the look and feel of fabrics formed on a loom. With the introduction of computer controls for tufting machines such as disclosed in the U.S. Pat. No. 4,867,080, greater precision and variety in designing and producing tufted pattern carpets, as well as enhanced production speeds, have been possible. In addition, computerized design centers have been developed to help designers design and create addition, computerized design centers have been developed to help designers design and create wider varieties of patterns, with requirements such as yarn feeds, pile heights, etc. being automatically calculated and generated by the design center computer.

Additionally, attempts have been made to develop tufting machines in which a variety of different color yarns and textured effects can be inserted into a backing material to try to create more free-flowing patterns. For example, specialty machines have been developed that include a moving head that carries a single hollow needle in which the ends of the different color yarns are individually fed to the needle for insertion into the backing material at a selected location. Other machines having multiple needles in a more conventional tufting machine configuration and which move the backing material forwardly and sidewise to place multiple colors in the backing material also have been developed. A problem exists, however, with such specialty tufting machines for individually placing yarns, in that the production rates of such machines generally are restricted as the yarns are placed individually in the backing material by the single needle or as the backing feed direction is changed. As a consequence, such specialized color patterning machines typically are limited to special applications such as formation of patterned rugs or carpets of limited or reduced sizes.

Accordingly, it can be seen that a need exists for a system and method that addresses these and other related and unrelated problems in the art.

SUMMARY OF THE INVENTION

Briefly described, the present invention generally relates to a yarn stitch or color distribution control system for a tufting machine for use in controlling placement and density of yarns or stitches with enhanced selectivity so as to enable formation of patterned tufted articles, such as carpets having a variety of pattern effects and/or colors, including the formation of substantially free-flowing multi-color patterns and/or carpets with a woven or loom formed appearance. The tufting machine with the stitch distribution control system of the present invention typically will include a tufting machine controller for controlling the operative elements of the tufting machine, as well as operating the stitch distribution control system according to the present invention for forming a desired scanned and/or designed pattern. The pattern can include various desired pattern effects, including different pile heights, cut and/or loop pile tufts in various tuft rows, and other textured effects, as well as the placement of various color yarns so as to be visible at selected locations across the backing to thus provide a desired density of retained colors/stitches per square inch. For example, the pattern can contain all loop pile tufts, all cut pile tufts, and/or combinations of cut and loop pile tufts, including variable pile height tufts and other sculptured or pattern texture effects.

The tufting machine further will include one or more needle bars having a series of needles spaced therealong, with a tufting zone defined along the path of reciprocation of the needles. A backing material is fed at a programmed or prescribed rate of feeding through the tufting zone for tufting of the yarns therein. As a result, as the backing material is fed through the tufting zone, the needles are reciprocated into and out of the backing material to form loops of yarns therein.

The stitch distribution control system according to the present invention will not only operate to control the tufting operations of the tufting machine, but further can include image recognition software to enable the stitch distribution control system to read and recognize scanned and/or designed pattern images including finished carpet designs with texture information such as pile heights, loop and/or cut pile tuft placement, drawings, photographs, etc., in addition to receiving input pattern instructions. The stitch distribution control system can automatically generate a pattern program file including a map or field of pattern pixels or tuft/stitch locations for the yarns/stitches of the scanned and/or designed pattern, as well as can calculate steps or parameters for controlling yarn feed, backing feed and the other operative elements of the tufting machine to form in the desired scanned and/or designed pattern. The stitch distribution control system further can recognize and correlate pattern colors to corresponding positions in a creel for the tufting machine based upon the thread-up of colors of the needle bar(s) in order to optimize the use of the creel, and additionally will automatically calculate a cam/shift profile (or select a preprogrammed cam profile as needed), and will calculate an effective or operative process stitch rate at which the pattern will be run to achieve the appearance of a desired fabric stitch rate or pattern density in the finished tufted article.

A shift mechanism can be provided for shifting the needle bar(s) transversely across the tufting zone, and multiple shift mechanisms typically will be utilized where the tufting machine includes more than one shifting needle bar. The shift mechanism(s) can include one or more cams, servo motor controlled shifters, or other shifters such as a "SmartStep" shift mechanism as manufactured by Card-Monroe Corp., which shift the needle bar in accordance with the scanned and/or designed pattern shift steps. Alternatively, the shift mechanism also can include a backing material or jute shifter for shifting the backing material laterally with or without the shifting of the needle bar(s). The shift steps for the scanned and/or designed pattern will be accomplished in accordance with the cam or shift profile calculated or selected for the pattern by the stitch distribution control system upon input and reading of the scanned and/or designed image of the desired pattern appearance into the tufting machine system controller. The cam or shift profile further can be varied depending on the number of colors to be used in the scanned and/or the designed pattern being formed. For example, for three, four, five or more colors, three, four, five or more color cams or cam/shift profiles can be designed and/or utilized for shifting each needle bar.

The tufting machine further generally will include at least one pattern yarn feed mechanism or attachment for controlling the feeding of the yarns to their respective needles. The at least one pattern yarn feed control mechanism or attachment will be operated to selectively control the feeding of the yarns to their selected needles according to the pattern instructions created or developed by the stitch distribution control system based on the scanned and/or designed image of the desired carpet pattern appearance. As a result, the yarns to be shown on the face or surface of the tufted article generally will be fed in amounts sufficient to form the desired height cut or loop tufts, while the non-appearing yarns, which are not to be shown in the tufted field, will be pulled low or backrobbed, or removed from the backing material. For each pixel or stitch location, a series of yarns generally will be presented, and any yarns not selected for appearance at such pixel or stitch location will be pulled back and/or removed. Thus, only the desired or selected yarn/color to be placed at a particular stitch location or pixel typically will be retained at such stitch location or pixel, while the remaining yarns/colors will be buried or hidden in the pattern fields being sewn at that time, including pulling the yarns out of the backing so as to float on the surface of the backing material. The pattern yarn feed pattern mechanism can include various roll, scroll, servo-scroll, single end, or double end yarn feed attachments, such as, for example, a Yarntronics™ or Infinity™ or Infinity IIE™ yarn feed attachment as manufactured by Card-Monroe Corp. Other types of yarn feed control mechanisms also can be used. The stitch distribution control system further typically will control the operation of the shift mechanism(s) and yarn feed mechanism(s) according to the pattern instructions developed thereby based on the scanned and/or designed pattern image input into the stitch distribution system.

Additionally, a looper or hook assembly including gauge parts such as cut-pile hooks, loop pile loopers, level cut loopers or hooks, and/or cut/loop hooks each having a biased clip attached to the body of the cut/loop hook, for selectively retaining loops of yarns thereon, generally will be provided below the tufting zone in a position so as to engage the needles as the needles penetrate the backing material, to pick and/or pull loops of yarns therefrom. In one embodiment, a series of the level cut loop loopers can be individually controlled by the stitch distribution control system during each stitch, based on the pattern stitch being formed and shift profile step therefore, so as to be actuated or fired selectively for each stitch according to whether the loops of yarn being formed thereby are to be pulled back or backrobbed, and thus hidden upon the formation of each stitch in the scanned and/or designed pattern, kept as loop pile tufts, or retained on the level cut loop looper to form a cut pile tuft. In other embodiments, other configurations and/or combinations of loop pile loopers, cut pile hooks, cut/loop hooks and/or level cut loop loopers also can be used.

The stitch distribution control system according to the principles of the present invention further generally will be operated at increased or denser effective or operative process stitch rates than conventional tufting processes. Typically, the operative or effective process stitch rate run by the stitch distribution control system will be approximately equivalent to the number of colors or tufts of a desired pile type and/or height being run in the programmed pattern multiplied by a desired or prescribed fabric stitch rate or number of retained stitches per inch or pattern density desired to appear on the face of the tufted article, such as 8 stitches per inch, 10 stitches per inch, etc. As a result, for patterns with 2-4 or more colors, the effective stitch rates run can be on the order of 16, 24, 32, or more stitches per inch for a ⅛th gauge machine, 20, 30, 40 or more stitches per inch for a $1/10^{th}$ gauge machine, etc., to achieve the appearance of the desired number of retained stitches per inch for the tufts to be seen on the surface of the backing while hiding the non-appearing or non-selected yarns. Thus, while the finished tufted article may have the appearance of, for example, 8-10 stitches per inch in a desired color field, there actually may be 16, 24, 40 or more stitches actually sewn, depending on the number of colors in the scanned and/or designed pattern, and desired or prescribed number of stitches per inch at which the backing material is fed. As a further consequence, as the needle bar(s) is shifted during the formation of the pattern stitches, for each color or tuft to be taken out or back-robbed and thus hidden by the surface yarns or tufts in the finished patterned article, the increased number of stitches per inch will provide sufficient enhanced density to the finished patterned tufted article to avoid a missing color or gap being shown or otherwise appearing in the finished patterned article.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
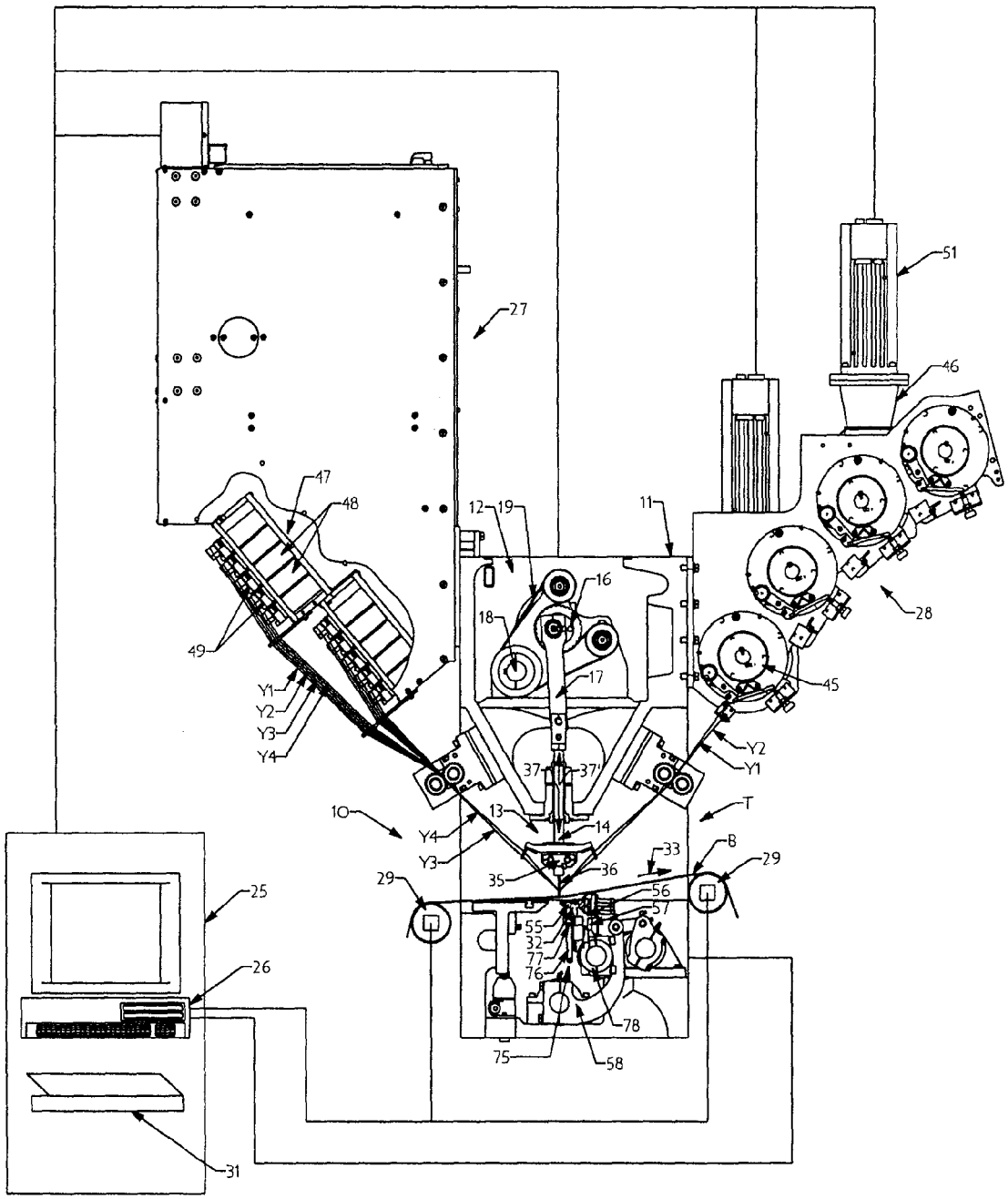
FIG. 1 is a side elevational view of a tufting machine incorporating the stitch distribution control system of the present invention.

Referring now to the drawings in which like numerals indicate like parts throughout the several views, in accordance with one example embodiment of the yarn stitch or color distribution control system according to the principles of the present invention, as generally illustrated in FIGS. 1-5C, a tufting machine 10 is provided for controlling placement and density of individual stitches or yarns Y1-Y4, etc., at desired stitch locations in the backing material B and with enhanced selectivity so as to enable the formation of tufted articles having a desired density of retained stitches per square inch, with a variety of varying or free-flowing pattern effects selectively formed therein. Such pattern effects can include formation of all loop pile tufts, all cut pile tufts, or combinations of cut and loop pile tufts in the backing material, including being formed in the same tuft rows, formation of varying pile heights, and formation of multi-color patterns of various geometric and/or free-flowing designs. Additionally, while four yarns/colors generally are indicated in the embodiments described below, it will be understood that more or fewer different color yarns (i.e., two color, three color, five color, six colors, etc., as illustrated in FIGS. 6A-7D) also can be utilized in the stitch distribution control system of the present invention.

As generally illustrated in FIG. 1, the tufting machine 10 includes a frame 11, including a head portion 12 housing a needle bar drive mechanism 13 and defining a tufting zone T. The needle bar drive mechanism 13 (FIGS. 1, 3 and 4A) typically includes a series of push rods 14 connected to a gear box drive 16 or similar mechanism, by connector rods 17. The gear box drive 16 in turn is connected to and driven off a main drive shaft 18 (FIGS. 1 and 2A) for the tufting machine by one or more drive belts or drive chains 19, with the main drive shaft 18 itself being driven by a motor, such as a servo motor. Alternatively, the push rods 14 of the needle bar drive mechanism 13 can be directly connected via connector rods 17 to the main drive shaft 18 so as to be driven directly off the main drive shaft to control operation of the main drive shaft motor (not shown).

An encoder additionally can be provided for monitoring the rotation of the main drive shaft and reporting the position of the main drive shaft to the stitch distribution control system 25 (FIG. 1) controlling the operation of the tufting machine 10. The stitch distribution control system 25 generally will comprise a tufting machine control such as a "Command-Performance™" tufting machine control system as manufactured by Card-Monroe Corp., typically including a computer/processor or system controller 26. The system controller will be programmed with the control methodology for operation of the stitch distribution control system, as well as with various pattern information. The system controller will monitor and control the operative elements of the tufting machine 10, such as the needle bar drive mechanism 13, yarn feed attachments 27/28, backing feed rolls 29, the main drive shaft 18, a needle bar shift mechanism 31 (FIGS. 2A-4A) and a looper or hook assembly 32 mounted beneath the tufting zone T of the tufting machine in accordance with the calculated/determined pattern instructions developed by the stitch distribution control system, as discussed more fully below. The stitch distribution control system 25 (FIG. 1) further can receive and execute or store pattern information in memory storage of the system controller 26. In response to developed/programmed pattern instructions, the stitch distribution control system 25 will control the operative elements of the tufting machine 10 in order to form the desired tufted patterns in the backing material B as the backing material is passed through the tufting zone T in the direction of arrow 33 by the backing feed rolls 29.

For operation of the stitch distribution control system 25, the tufting machine system controller 26 generally can be programmed with a desired pattern for one or more tufted articles, including calculated pattern steps, which steps can be created or calculated manually or through the use of design centers or design software as understood by those skilled in the art. Alternatively, the controller 26 can include image recognition software to enable scanned and/or designed pattern images, such as designed patterns, including pile heights and other characteristics such as placement of loop pile and cut pile tufts in the pattern shown by, for example, different colors or similar markers or indicators, as well as photographs, drawings and other images, to be input, recognized and processed by the control system, and a scanner or other imaging device 31 (FIG. 1). The stitch distribution control system can recognize and identify various pattern characteristics, including the colors of a designed pattern image indicative of texture effects such as placement or location of loop and/or cut pile tufts and assign selected yarns thereto. Additionally, the stitch distribution control system also can read and recognize colors of an input scanned pattern and can assign supply positions for the yarns being supplied from a supply creel to various ones of the needles based on the thread-up sequence of the needles of the needle bar so as to optimize the supplies of the various color yarns in the creel for the best use thereof, to form the recognized pattern fields from the scanned pattern images. The stitch distribution control system further generally can create a pattern field or mapping, including a series of pattern pixels or tuft/stitch placement locations identifying the spaces or locations at which the various color yarns and/or cut/loop pile tufts will be selectively placed to form the imaged pattern. The desired pattern density, i.e., the desired number of stitches per inch to appear on the face of the finished patterned tufted article, also will be analyzed and an effective or operative process stitch rate for the pattern calculated to achieve the appearance of the desired fabric stitch rate of the scanned and/or designed pattern.

The stitch distribution control system of the invention further can include programming of various cam or shift profiles, or can calculate a proposed cam or shift profile based on the scanned or input designed pattern image. An operator additionally can select a desired cam profile or modify the calculated cam profile, such as by indicating whether the pattern is to have 2, 3, 4, 5, or more colors or a desired number of pattern repeats, or can allow the system to proceed automatically with the calculated cam profile. The operator also can manually calculate, input and/or adjust or change the creel assignments or yarn color mapping created by the color distribution control system as needed via a manual override control/programming. Effectively, in one embodiment an operator can simply scan or otherwise input a designed pattern image, photograph, drawing, etc., directly at the tufting machine, and the stitch distribution control system of the present invention can automatically read, recognize and calculate the pattern steps/parameters, including yarn feed, effective stitch rate to achieve a desired pattern density, cam/shift profile, and color arrangement of yarns to match the scanned and/or designed pattern image, and will thereafter control the operation of the tufting machine to form this scanned and/or designed pattern.

As indicated in FIGS. 1-4A, the needle bar drive mechanism 13 of the tufting machine 10 also will include one or more needle bars 35 attached to and driven by the push rods 14 and carrying a series of needles 36 that can be arranged in in-line or staggered, with offset rows spaced transversely along the length of the needle bar and across the tufting zone of the tufting machine. The needle bar(s) 35 further can be shiftable transversely across the width of the backing material. While only a single shifting needle bar 35, with an inline row of needles 36 arranged therealong is shown in the figures, it will be understood by those skilled in the art that additional arrangements of dual and single shifting needle bars having spaced rows of needles 36 arranged in-line or in a staggered or offset configuration also can be utilized in the tufting machine 10 incorporating the stitch distribution control system according to the present invention.

During operation of the needle bar drive mechanism, the needles are reciprocated, as indicated by arrows 37 and 37' (FIG. 2B), into and out of the backing material B, carrying the yarns Y1-Y4 so as to insert or place loops of yarn in the backing material for forming loop pile and/or cut pile tufts 38 in the backing material. While front and rear yarn feeds are shown, the system can be used with front or rear yarn feeds only and/or both front and rear yarn feeds as indicated. Additionally, as illustrated in the embodiments shown in FIGS. 3 and 4, the shift mechanism 31 generally will be linked to the needle bar 35 for shifting the needle bar in the direction of arrows 41 and 41', transversely across the tufting zone according to calculated or computed pattern instructions. The shift mechanism 31 can include a Smart Step™ type shifter as manufactured by Card-Monroe Corp., or alternatively can include various other types of shift mechanisms including servo-motor or hydraulically controlled shifters, and/or pattern cam shifters as are conventionally used. Still further the shift mechanism 31 also can include backing material or jute shifters, operable separately or in conjunction with a needle bar shifter, for shifting the backing material laterally with respect to the needles.

As noted above, as a further part of the pattern information/instructions created and run by the stitch distribution control system 25 (FIG. 1) according to the present invention, the cam profile or shift profile of the shift steps will be calculated for the scanned and/or designed pattern image for controlling the shifting of the needle bar(s) as necessary to form the desired scanned and/or designed pattern. The calculated or selected pattern shift steps or cam profile further can be varied depending on the number of colors used in the pattern being run.

Figure 6A:
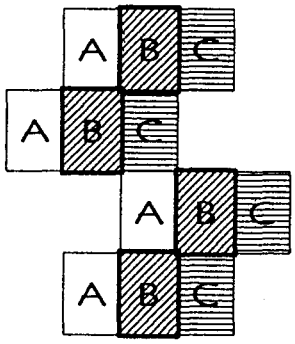
FIGS. 6A-6D are schematic illustrations of example shift/step movements for tufting patterns having different numbers of colors using one embodiment of the present invention.
Figure 6B:
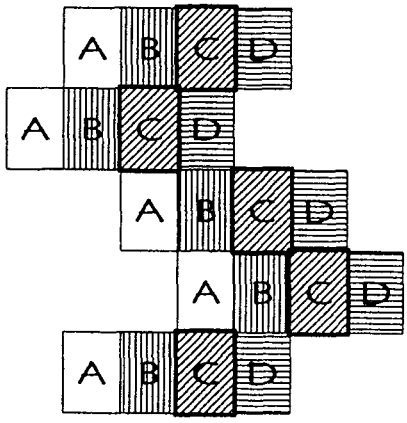
Figure 6C:
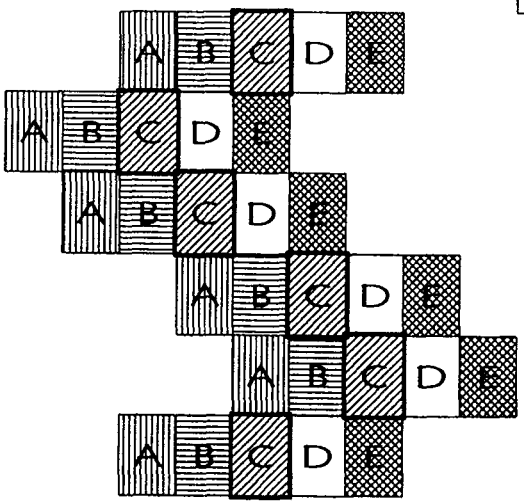
Figure 6D:
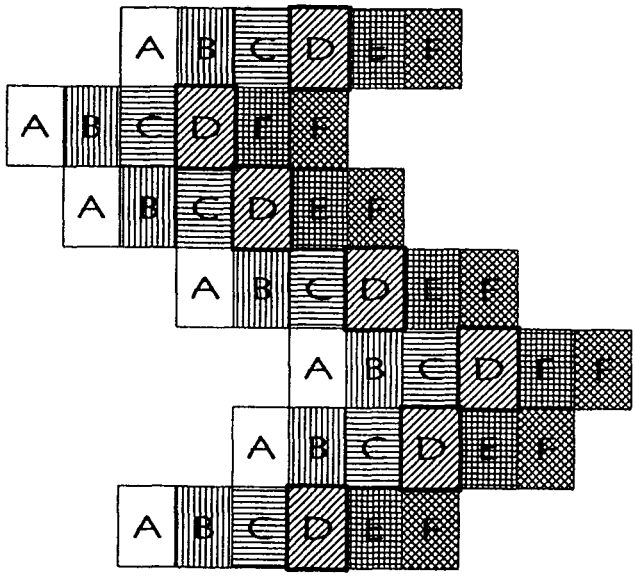

In one embodiment, FIGS. 6A-6D illustrate various shift or stepping patterns for the needle bar, reflecting the shifting of the needle bar where three, four, five or six different color yarns are utilized in the pattern, and illustrate single and double step or jump segments followed to avoid oversewing prior sewn tufts. For example, for running a stepping pattern utilizing three different colors of yarns, as indicated in FIG. 6A, an initial step or shift can be made to the right, which would then be followed by a double gauge shift or jump, ending with a single gauge shift. Similarly, for four, five and/or six colors, shown in FIGS. 6B-6D, after an initial shift to the right of either a single or double gauge jump, the pattern then shifts back to the left using single and double gauge jumps or shifts in order to avoid sewing over or over-tufting previously sewn tufts. Additionally, while the initial shift or jump is shown as going to the right in FIGS. 6A-6B, it is also possible to start the shift steps to the left. Still further, as the needle bar is shifted, the backing material also is generally fed through the tufting machine at an increased or denser stitch rate to achieve a denser pattern or fill-in of the selected colors for the particular field of the pattern. As a further alternative, double or greater jumps can be used to skip or bypass presentation of yarns to selected stitch locations, such as locations where no yarn is selected for insertion.

Figures 7A, 7B, 7C, 7D:
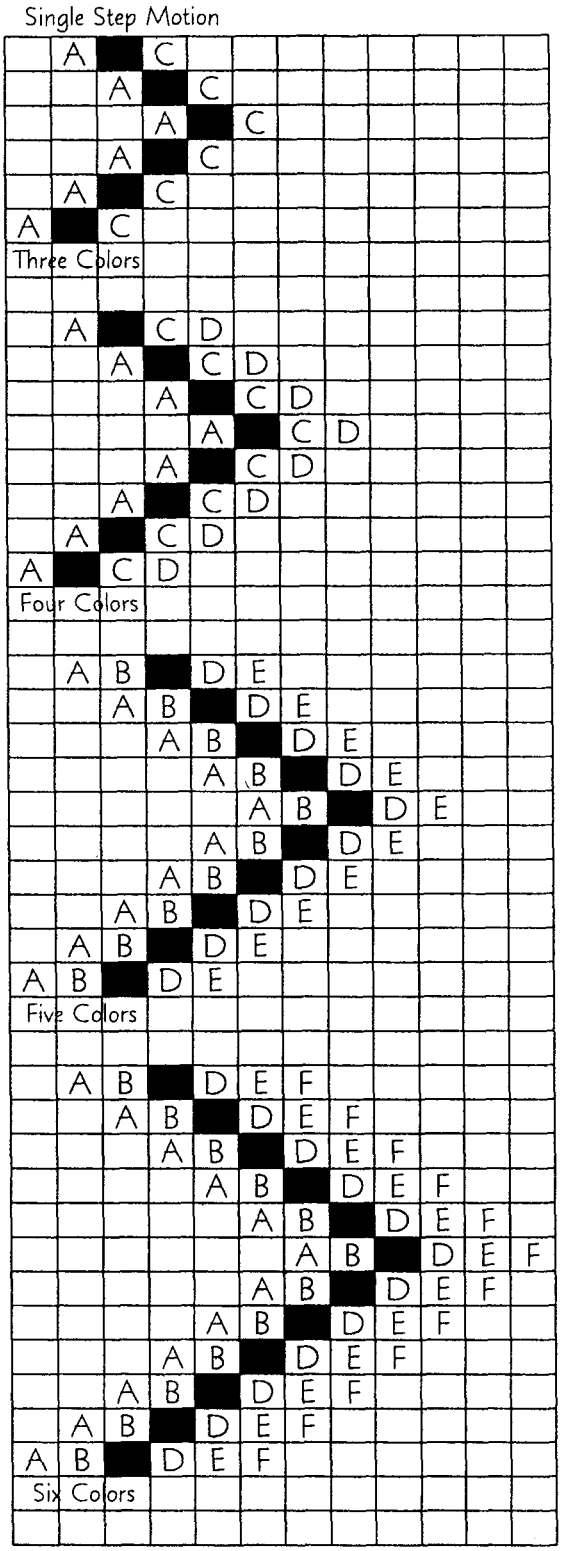
FIGS. 7A-7D are schematic illustrations of example shift/step movements for tufting patterns having different numbers of colors using another embodiment of the present invention.

In another embodiment, such as illustrated in FIGS. 7A-7B, various example single step motion cam movements or shift steps are shown for 3, 4, 5 and/or 6 colors of yarns being run under control of the stitch distribution control system according to the principles of the present invention. Each of the needle bar shift or cam steps generally is shown as moving in a single increment or jump, as opposed to the double jumps or steps shown in FIGS. 6A-6D, although combinations thereof also can be used as needed. In the cam movements or shift steps illustrated in FIGS. 7A-7B, the shift movement typically will take place in one direction across the entire range of movement before turning and moving back across the range, as opposed to the single/double cam movements or step motions illustrated in FIGS. 6A-6D in which the movement is across the centerline of the color arrangement and is maintained as close as possible to a symmetrical range of movements across this centerline.

The range of movement further generally will depend upon the number of colors utilized as shown in FIGS. 7A-7D. For example, in FIG. 7C where five colors A-E are illustrated and color C is the color yarn selected to be shown or appear on the face of the tufted article, after the initial stitch, the needle bar can be shifted four steps in a first direction, here shown as moving to the right although the stepping movement could start to the left as well, and after the fifth stitch (fourth step or jump), the needle bar will be shifted in the opposite direction in a series of single jumps to return to the initial or starting stitch position. Additionally, the stitch distribution control system, as noted above, can read/recognize the different colors of the scanned and/or designed pattern, and based upon the number of colors detected/determined, can adjust the needle bar starting position so that all movement within a desired color range is completed before the direction of the needle bar is reversed, as indicated in FIGS. 7A-7D, to help prevent the same color being placed within the tufted range more than a desired number of times as needed to form the selected tuft field or range of the scanned and/or designed pattern. As a further alternative, the number of steps or shifts of the needle bar(s) can be fewer or more than the number of colors before the shifting motion of the needle bar is reversed, i.e., for a 4-color pattern, the needle carrying color C can be shifted or jumped 3 or 4 steps before reversing (i.e., moving in steps 1, 2, 3, 4, 3, 2, 1; or 1, 2, 3, 4, 4, 3, 2, 1).

Further, in contrast to some conventional tufting systems wherein the fabric stitch rate for tufting patterns run thereby generally has been matched to the gauge of the tufting machine, i.e., for a tenth gauge tufting machine the fabric stitch rate typically will be approximately ten stitches per inch, while for an eighth gauge machine, the fabric stitch rate will be approximately eight stitches per inch, in the present invention, the operative or effective process stitch rate run by the stitch distribution control system will be substantially higher than such typical conventional desired fabric stitch rates. With the stitch distribution control system according to the present invention, this enhanced operative or effective process stitch rate generally will be approximately equivalent to the desired fabric stitch rate or density for the finished tufted article, i.e., the article is to have the appearance of 8, 10, 12, etc., stitches per inch on its face, which is multiplied by the number of different colors being run in the pattern. Thus, with the stitch distribution control system according to the present invention, for a tenth gauge machine generally run to achieve a desired fabric stitch rate of approximately ten stitches per inch appearing in the tufted article, for example, if there are three colors in the pattern, the operative or effective process stitch rate calculated and run by the stitch distribution control system will be determined by multiplying the desired stitch rate (10 stitches per inch), by the number of colors (3), for an operative or effective process stitch rate of approximately thirty stitches per inch, for four colors, while the operative or effective process stitch rate for a 4 color pattern can be approximately forty stitches per inch, fifty stitches per inch for five colors, etc.

Figure 3:
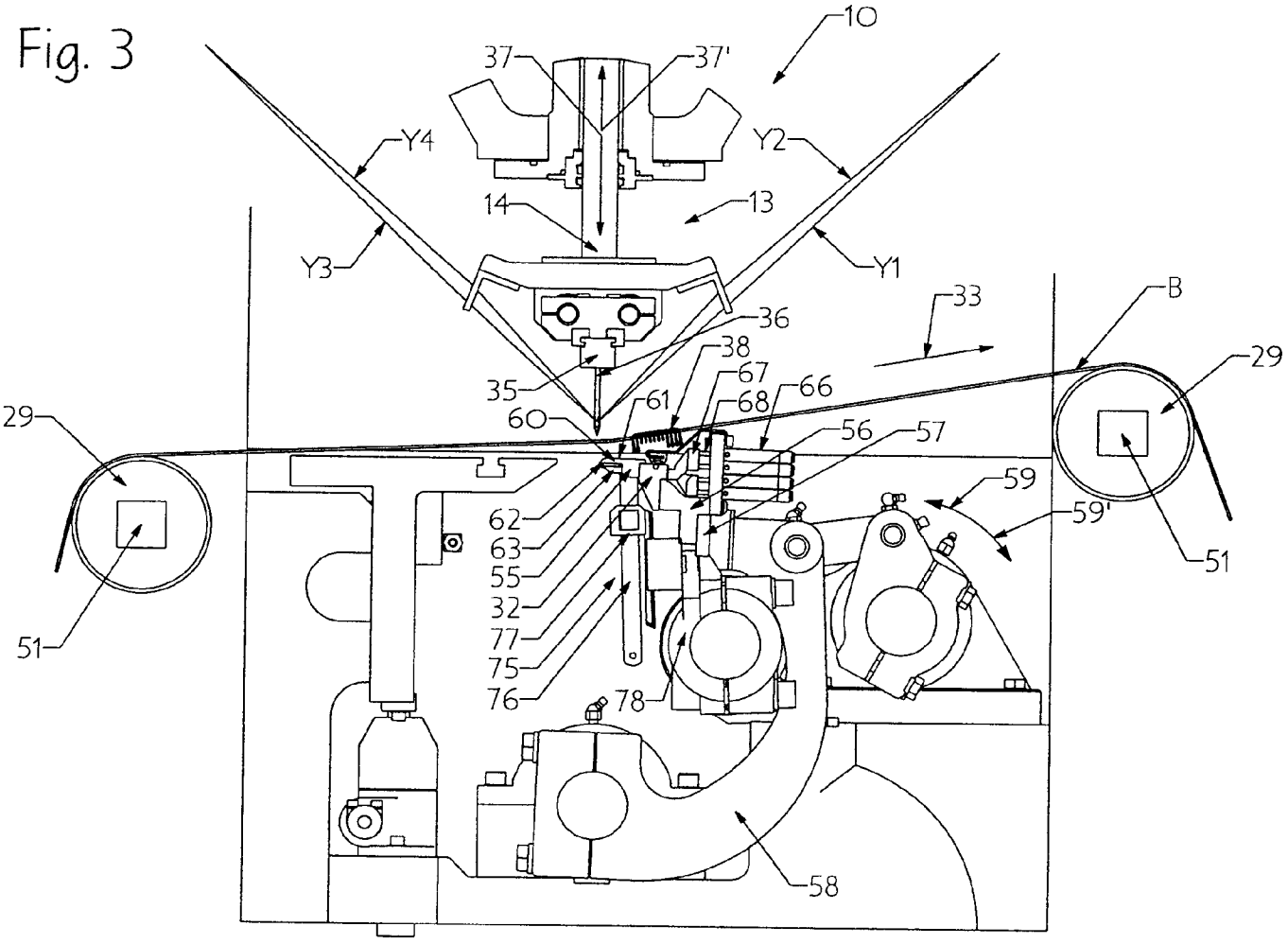
FIG. 3 is a side elevational view of the tufting machine of FIG. 1, illustrating the needles with level cut loopers.
Figure 4A:
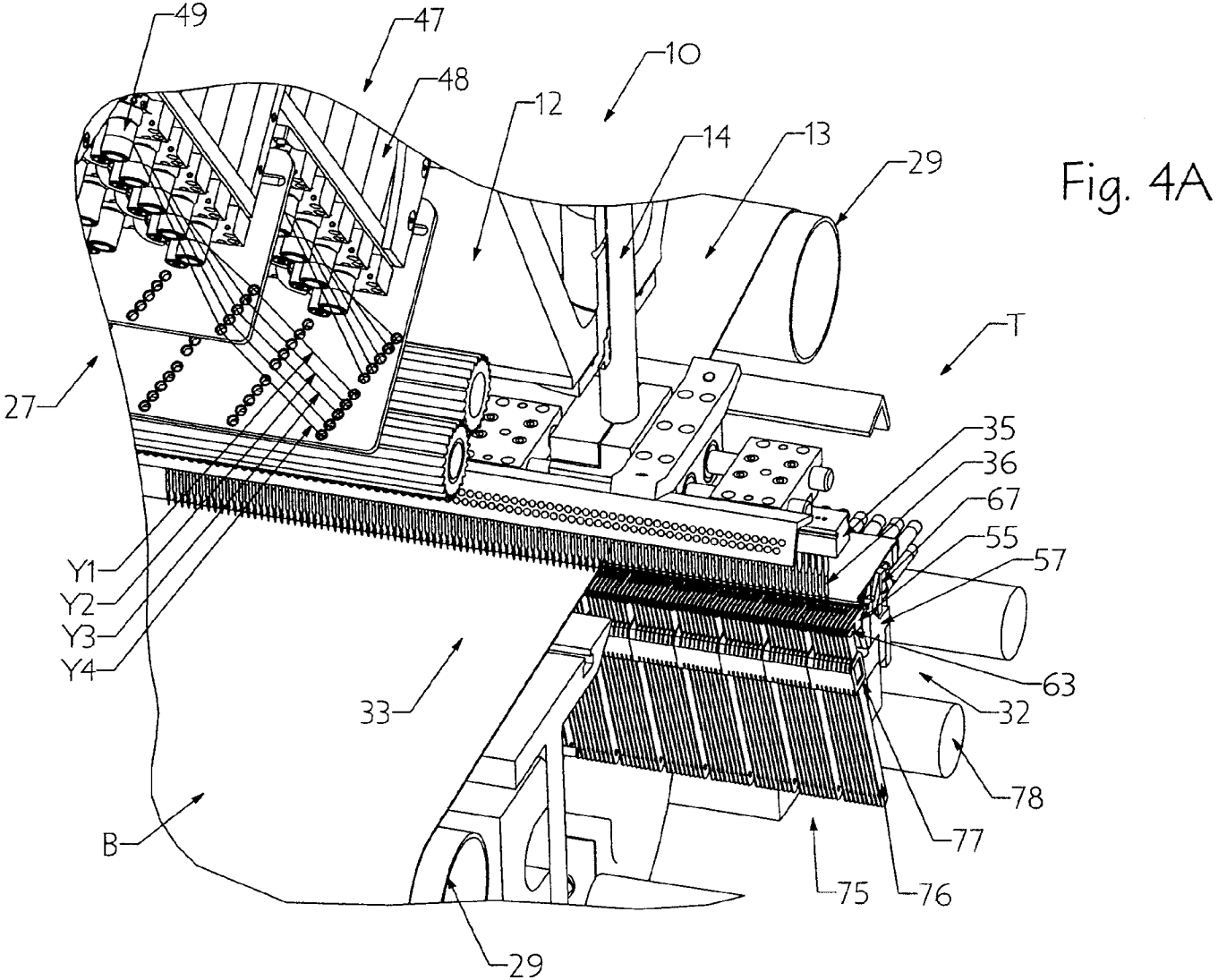
FIGS. 4A-4B are perspective illustrations, with parts broken away, illustrating the operation of the level cut loop loopers and shifting of the needle bars in the stitch distribution control system of FIGS. 1 and 3.
Figure 8:
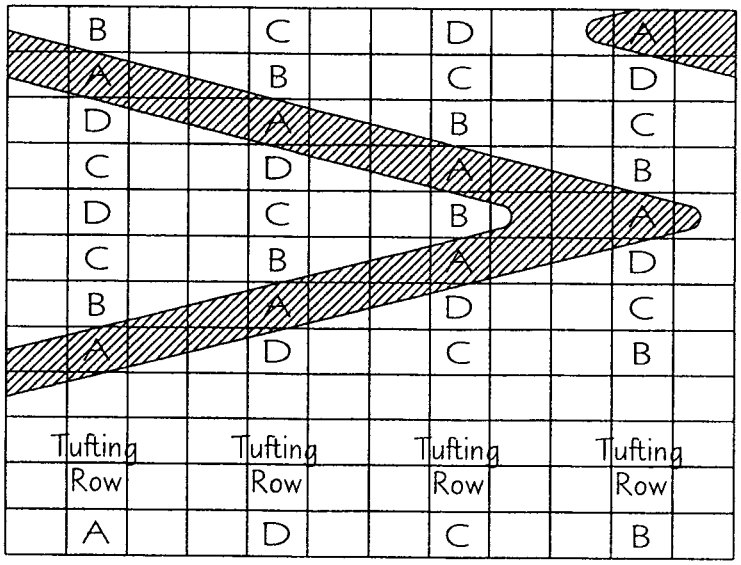
FIG. 8 is a schematic illustration of a series of pixels or stitch placement locations for a pattern run by the stitch distribution control system and having, for example, four colors.

As additionally indicated in FIGS. 1, 3 and 4A, one or more yarn feed attachments 27 and/or 28 also generally can be mounted to the frame 11 of the tufting machine 10 for controlling the feeding of the different color yarns Y1-Y4, etc., to each of the needles during operation of the tufting machine. Each yarn feed attachment selectively feed the yarns to their respective needles, so that the surface yarns or tufts that are to appear on the face of the tufted article are fed in amounts sufficient to form the desired cut/loop tufts, while the non-appearing yarns that are to be hidden in particular color and/or texture fields of the pattern will be backrobbed and/or pulled low or out of the backing material. As indicated in FIG. 8, during operation, each color or type yarn that can be placed/tufted at each pixel or stitch location generally will be presented to such pixel or stitch location for tufting, with only the yarn to be shown or appearing being retained at the pixel or stitch location. Thus, for the 4 color pattern shown in FIG. 8, for example, all 4 color yarns A, B, C and D can be presented to each pixel in the illustrated steps of the shift profile, with only the "A" yarn being retained, while the remaining yarns, B-D are presented and are pulled back and/or removed from the pixels or stitch locations. Accordingly, any time a needle is presented to a pixel or stitch location, if the yarn carried by that needle is to be retained or appear in the pixel or stitch location, the yarn feed is controlled to feed and form a tuft of yarn at the pixel or stitch location. If the yarn presented is not to be retained or appearing in the pixel or stitch location, it is pulled back and/or removed. If no yarns are selected for insertion at a particular pixel or stitch location, the needle bar further can be shifted to jump or otherwise skip or bypass presentation of the needles to that pixel or stitch location.

There are a variety of yarn feed attachments that can be utilized with the stitch distribution control system of the present invention for controlling the feeding of the different yarns Y1-Y4, etc., to various ones of the needles 36. For example, the pattern yarn feed attachments or mechanisms can comprise conventional yarn feed/drive mechanisms such as roll or scroll pattern attachments, as indicated at 28 in FIG. 1 having a series of rolls 45 extending at least partially along the tufting machine and driven by motors 46 under direction of the stitch distribution control system 25 (FIG. 1) for controlling the feeding of all of the yarns across the tufting machine to form pattern repeats and/or multiple pile heights and/or other texture effects across the width of the backing material, and including Quick Thread™, Enhanced Graphics™, and/or Multi Pile Height Scroll yarn feed controls/attachments as manufactured by Card-Monroe Corp. Alternatively, other types of pattern yarn feed attachments can be used, as indicated at 27, which have multiple yarn feed drives 47 (FIG. 1), each including a motor 48 and feed rolls 49, for controlling the feeding of specific sets of repeats of yarns to selected needles, including the use of individual yarn feed rolls or drives 48 for controlling the feeding of single yarns or pairs of yarns to each of the needles 36, such as single end/servo-scroll attachments, and/or the Infinity™ and Infinity IIE™ systems as manufactured by Card-Monroe Corp.

For example, U.S. Pat. Nos. 6,009,818; 5,983,815; and 7,096,806 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine. All of these systems can be utilized with the present invention and are incorporated herein by reference in their entireties. Additionally, while in FIG. 1 a roll or scroll-type pattern attachment is shown at 28 as being used in conjunction with a single or double end type yarn feed mechanism 27, it also will be understood by those skilled in the art that the pattern yarn feed mechanisms 27/28 utilized to control the yarn feed in the stitch distribution control system of the present invention can include single or double end yarn feed controls only, only scroll, roll, or similar attachments, and/or various combinations thereof, and further can be mounted along one or both sides of the tufting machine. Still further, the stitch distribution control system 25 can perform yarn feed compensation and/or yarn feed modeling to help control and reduce or minimize the amounts of non-retained/non-appearing yarns to be fed to avoid excess feeding of yarns and thus minimize waste during a tufting operation.

As indicated in FIGS. 1-5C, the backing material B is fed through the tufting zone along a feed direction or path indicated arrow 33 by the backing rolls 29 (FIGS. 1. 2A and 3) by the operation of drive motors 51 (FIG. 3) that are linked to and controlled by the stitch distribution control system. The backing material B generally is fed at the operative or effective process stitch rate for the pattern being formed by the stitch distribution control system of the present invention (i.e., the desired rate multiplied by the number of colors of the pattern), and is engaged by the needles 36 that insert the yarns Y1-Y4 (FIGS. 1 and 3) (to form the tufts 38) in the backing material. The feeding of the backing material B can be controlled by the stitch distribution control system in a variety of ways. For example, the tufting machine backing rolls 29 can be controlled to hold the backing material in place for determined number of stitches or cycles of the needle bar, or can move the backing material incrementally per a desired number of stitches, i.e., insert one stitch and move $1/40^{th}$ of an inch or run 4 stitches and move $1/10^{th}$ of an inch for a pattern with four colors and an effective stitch rate of 40 stitches per inch. Still further, the incremental movement of the backing material can be varied or manipulated on a stitch-by-stitch basis with the average movement of all the stitches over a cycle substantially matching the calculated incremental movement of the operative or effective process stitch rate. For example, for a 4-color cycle as shown in FIG. 7B, one stitch can be run at $1/80^{th}$ of an inch, the next two at $1/40^{th}$ of an inch, and the fourth at $1/20^{th}$ of an inch, with the average incremental movement of the backing over the entire 4-stitch cycle averaging $1/40^{th}$ of an inch, as needed, to achieve a desired stitch/color placement.

As shown in FIGS. 1 and 2A-2C, the looper/hook assembly 32 generally is mounted below the bed and tufting zone T of the tufting machine 10. As the needles penetrate the backing material, they are engaged by the looper/hook assembly 32 so as to form loops of yarns that then can be cut to form cut-pile tufts, or can be remain as loops according to each pattern step. The released loops of yarns can be back-robbed or pulled low or out of the backing by the operation of the pattern yarn feed attachment(s) 27/28 as needed to vary the height of the loops of the additional colored yarns that are not to be shown or visually present in the color field of the pattern being sewn at that step.

The looper/hook assembly 32 will include a series of gauge parts and can include loop pile loopers (FIGS. 2B-2C), cut pile hooks (FIG. 2A), level cut loop loopers or hooks (FIGS. 3-5C), cut/loop hooks (FIGS. 9A-9C) as well as various combinations of loop pile loopers, cut pile hooks, cut/loop hooks, and/or level cut loop loopers or hooks, with these gauge parts further potentially being arranged at different elevations to form different heights or other texture effects for the tufts of yarns being formed. As a result, the tufted article can be formed with substantially all loop pile tufts, all cut pile tufts or mixtures of loop and cut pile tufts, including formation of loop and cut pile tufts in the same longitudinal tuft row, and with further varying textural or sculptured pattern effects, including variations in the pile heights of the different tufts, etc., in addition to the formation of various geometric and/or free-flowing color pattern effects.

During operation of the tufting machine, the stitch distribution control system of the present invention will effectively present each one of the colors (i.e., 3, 4, 5, 6, etc.,) of yarns, or different types yarns, that could be sewn at a selected pattern pixel or tuft/stitch location to a looper/hook associated with that stitch location or pattern pixel, during each shift motion or cam movement cycle, such as illustrated in FIGS. 6A-7D, and per each incremental movement of the backing material. For example, for a four color pattern, such as is illustrated in FIG. 8, each of the one-four colors that can be sewn at a next pixel or stitch location, i.e., one, two, three, four, or no yarns can be presented at a selected pixel or stitch location, will be presented to a desired looper as the backing material is moved incrementally approximately $1/8^{th}$-1/40th of an inch per each shift motion or cam movement cycle. The looper or hook will engage the desired yarn for forming a selected tuft, while the remaining yarns generally are pulled low or back robbed by control of the yarn feed mechanism(s) therefore, with the yarns potentially being pulled out of the backing material so as to float along the backing material. Accordingly, each looper or hook is given the ability to tuft any one, or potentially more than one (i.e., 2, 3, 4, 5, 6, etc.,) of the colors of the pattern, or possibly none of the colors presented to it, for each pattern pixel or tuft/stitch location associated therewith during each shift sequence and corresponding incremental movement of the backing material. As noted, if none of the different type or color yarns is to be tufted or placed at a particular tuft or stitch location or pixel, the yarn feed can be controlled to limit or otherwise control the yarns of the needles that could be presented at such stitch location or pixel to substantially pull back all of the yarns or otherwise prevent such yarns from being placed or appearing at that stitch location, and/or the needle bar additionally could be controlled so as to jump or otherwise bypass or skip presentation of the needles/yarns to that stitch location or pixel.

Figure 2A:
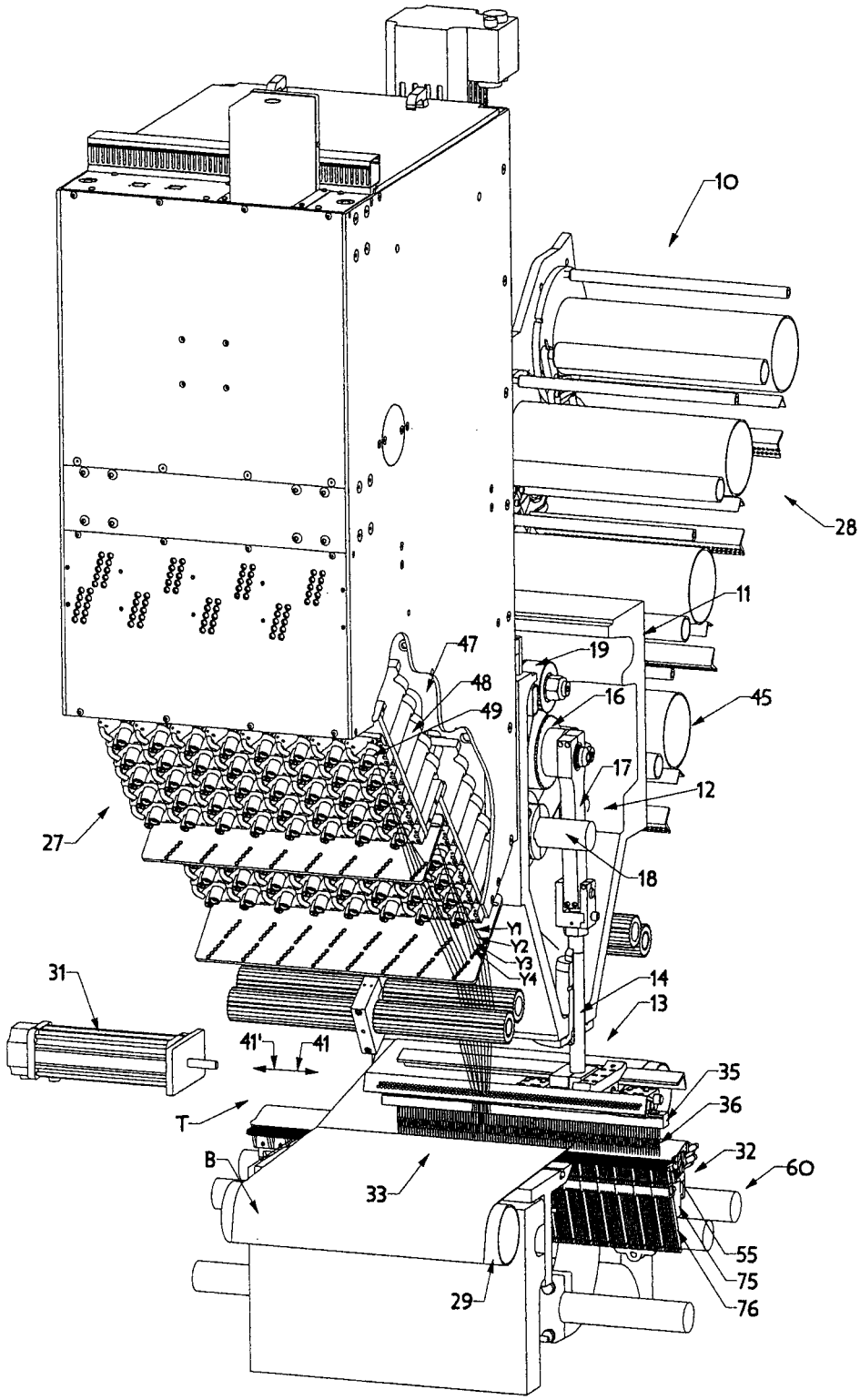
FIG. 2A is a perspective illustration of the stitch distribution control system of FIG. 1.
Figure 2B:
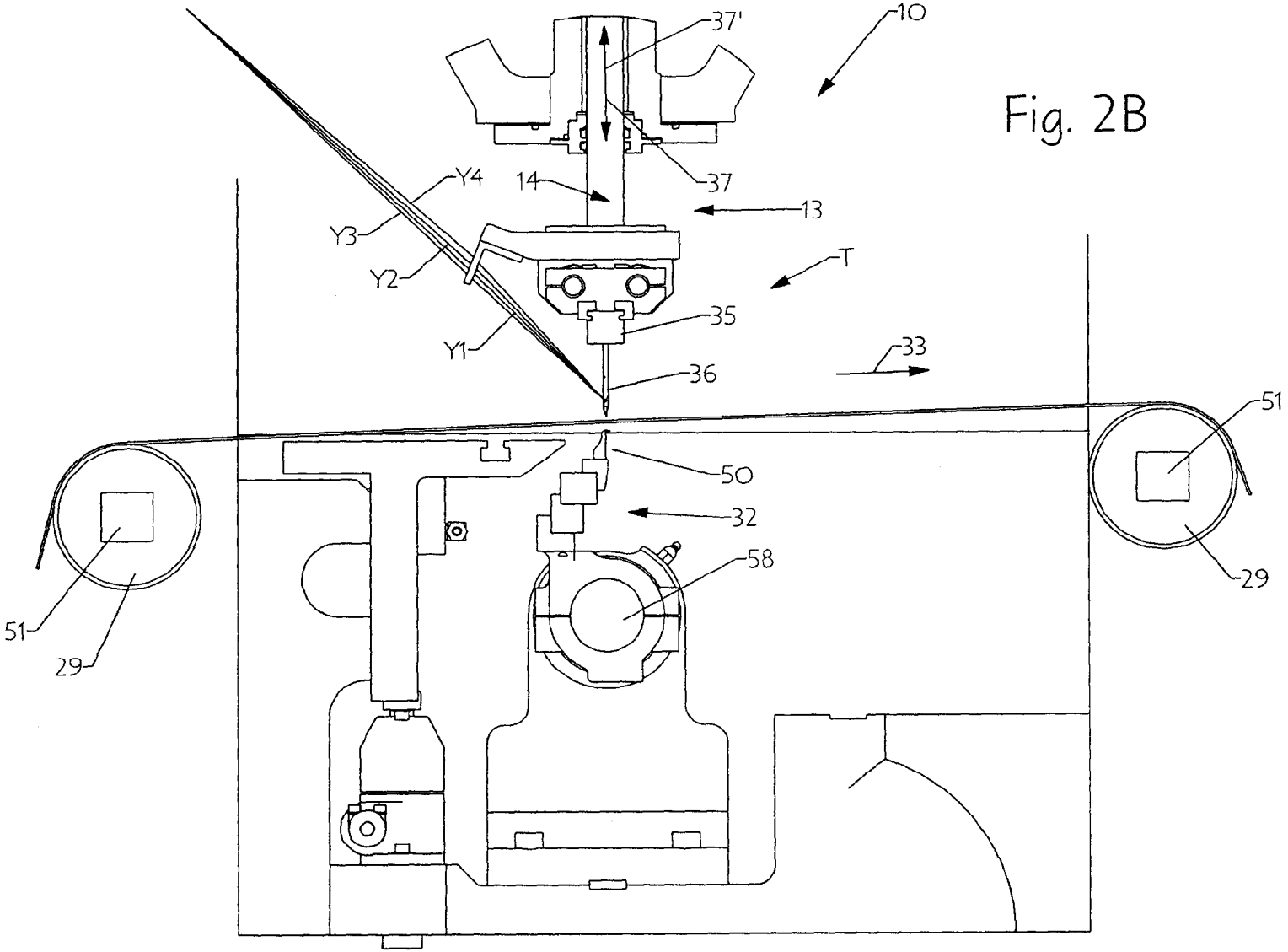
FIG. 2B is a side elevational view of the tufting machine of FIG. 1 illustrating the needles with loop pile loopers.
Figure 2C:
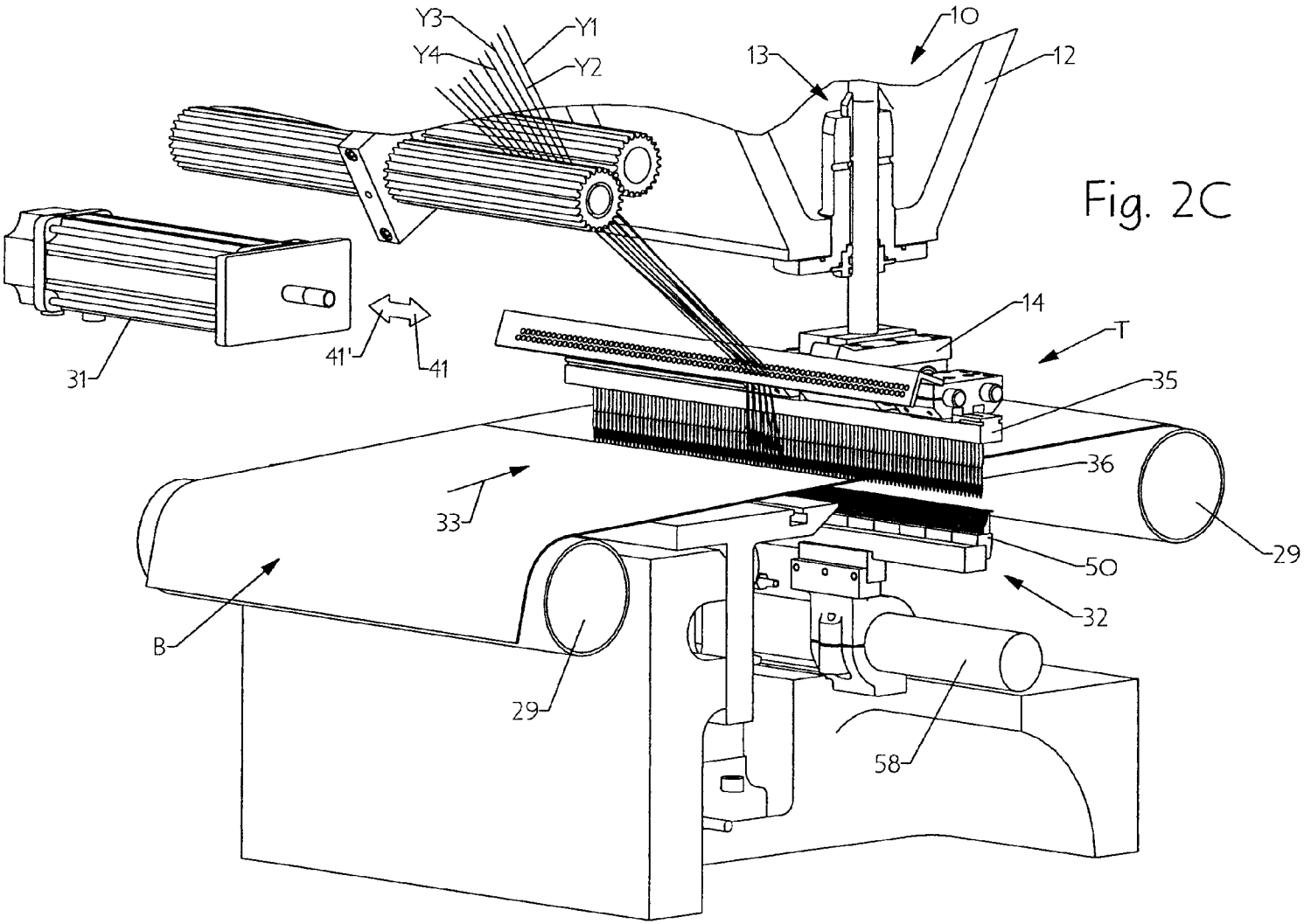
FIG. 2C is a perspective illustration, with parts broken away of the tufting zone of the tufting machine of FIGS. 2A-2B.

In one example embodiment of the stitch distribution control system according to the present invention, the looper/hook assembly 32 generally is shown in FIGS. 2A-2C as including a series of loop pile loopers 50 (FIGS. 2B-2C) for forming loop pile tufts in the backing, and cut pile hooks 60 (FIG. 2A) for forming cut pile tufts. Alternatively, FIGS. 3-5C show the use of a series of level cut loop loopers 55 (FIG. 3) mounted on a support block or holder 56 that is attached to a hook or looper bar 57 that is itself mounted on a reciprocating drive arm 58. The drive arm 58 reciprocates the level cut loop loopers 55 toward and away from the needles 36 in the direction of arrows 59 and 59', as the needles penetrate the backing material so that the level cut loop loopers engage the needles to pick and pull the loops of yarns therefrom. It also will be understood by those skilled in the art, however, that while the present invention as disclosed in the present embodiment is shown as being used with level cut loopers or hooks, it also is possible to utilize loop pile loopers and/or cut pile hooks, as well as combinations of level cut loop loopers, cut pile hooks, loop pile loopers and cut/loop hooks in the stitch distribution control system of the present invention in order to form the desired patterned articles.

Figure 4B:
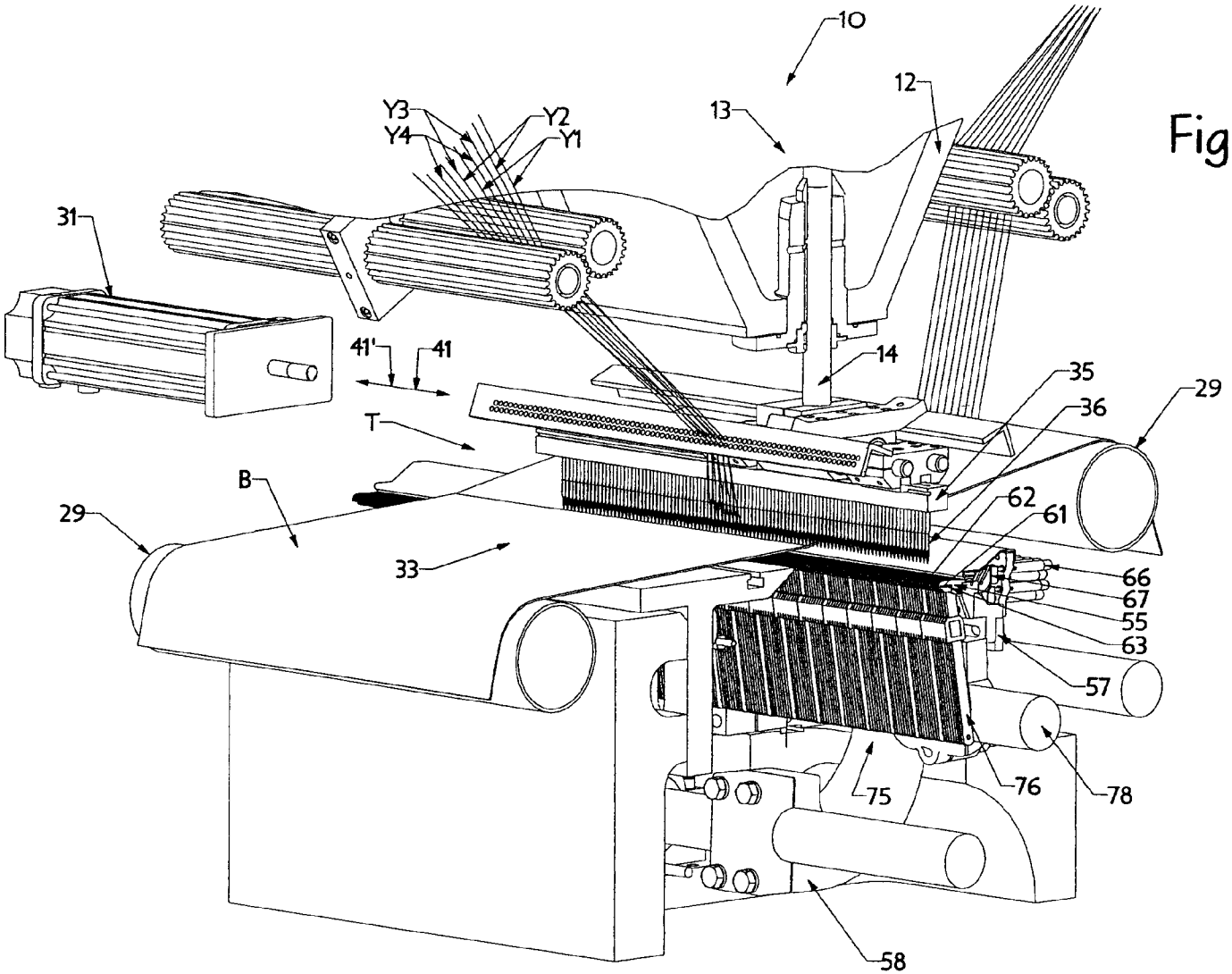

In a further embodiment, as indicated in FIGS. 3-4B, the looper/hook assembly 32 can include a series of level cut loop loopers 55, each of which generally includes a looper body 60, the rear portion of which is received in the support or hook block 56, a longitudinally extending throat portion 61, and a hooked front or bill portion 62 (FIG. 3) that extends downwardly therefrom. A series of slots (not shown) generally are formed within the support block 56 adjacent each looper body 60, through which clips 63 are slidably received so as to be movable from a retracted position rearward of the front portion 62 of each level cut loop looper 55, to an extended position, projecting adjacent or in contact with the front bill portion 62, as indicated in FIG. 3. In its extended position, each clip prevents a loop of yarn engaged by its associated level cut loop looper 55 from being captured and held behind the hooked front or bill portion 62 and thereafter being cut. Each of the clips generally includes an elongated body typically formed from metal, plastic, composite or other similar material having a first proximal end that is adapted to extend adjacent the front bill portion of each associated level cut looper, and a rear portion (not shown) that extends through the support block 56.

The clips further each generally are linked to an associated actuator 66 by a connector or gate 67 which itself is connected to one or more output or drive shafts 68 of its associated actuator(s) 66. The actuators 66 are mounted in spaced, vertically offset rows, along an actuator block and generally can include pneumatic or other similar type cylinders or can include servo motors, solenoids or other similar type mechanisms for driving the clips between their extended and retracted positions. Each connector or gate 67 further includes an actuator connector portion configured to be connected to an output shaft of an actuator, an extension portion extending forwardly from and at an angle with respect to the actuator connector portion along a direction transverse to the axial direction and a slot portion connected to the extension portion and defining a connector slot extending from the extension portion. The connector slot is configured to engage an associated clip 63, with the connector slot further including laterally spaced side walls defining the slot in which the clip is received. Additionally, each connector slot can be about 0.001 inches-0.003 inches greater in width than the width of the clip that is received therein to enable seating of the clips therein while preventing twisting of the clips during movement thereof, as the lateral side walls generally will prevent substantial lateral movement of the clips relative to their connectors and thus will prevent rotation of the clips about the longitudinal axis of the clips.

Figure 5A:
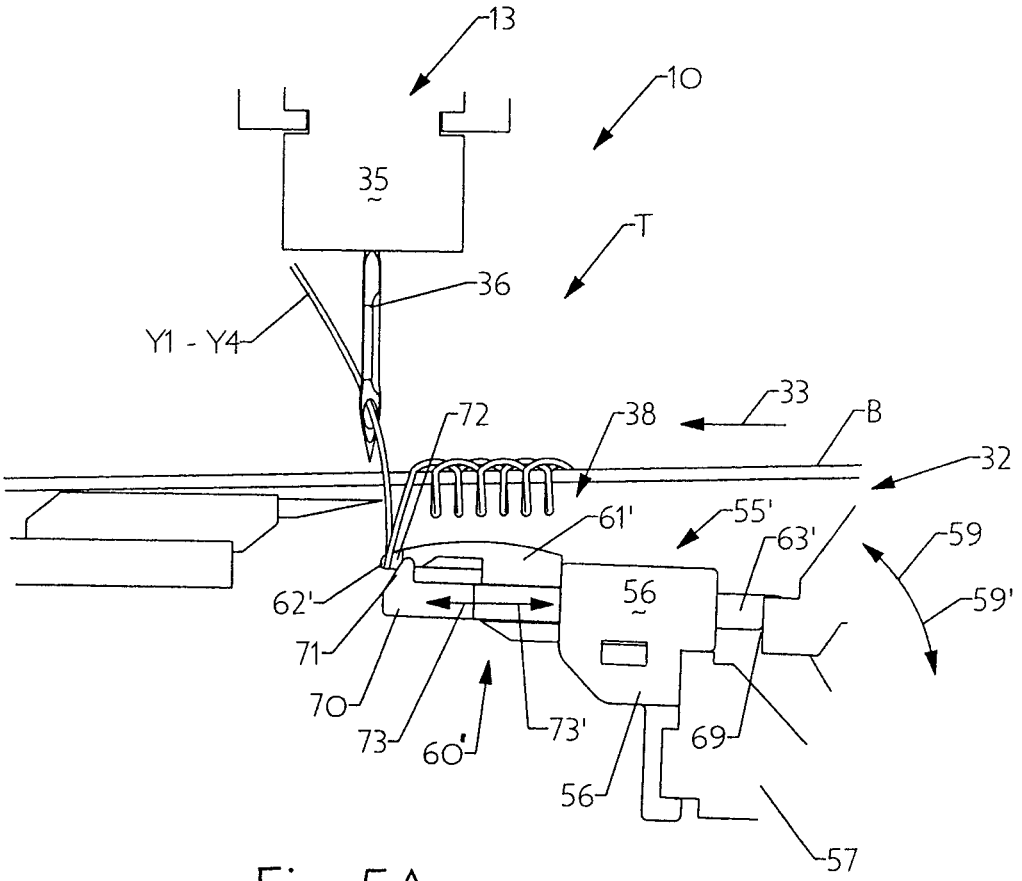
FIGS. 5A-5C are side elevational views illustrating a portion of a tufting zone including another example embodiment of a level cut loop looper assembly in the tufting machine of FIGS. 1 and 3.
Figure 5B:
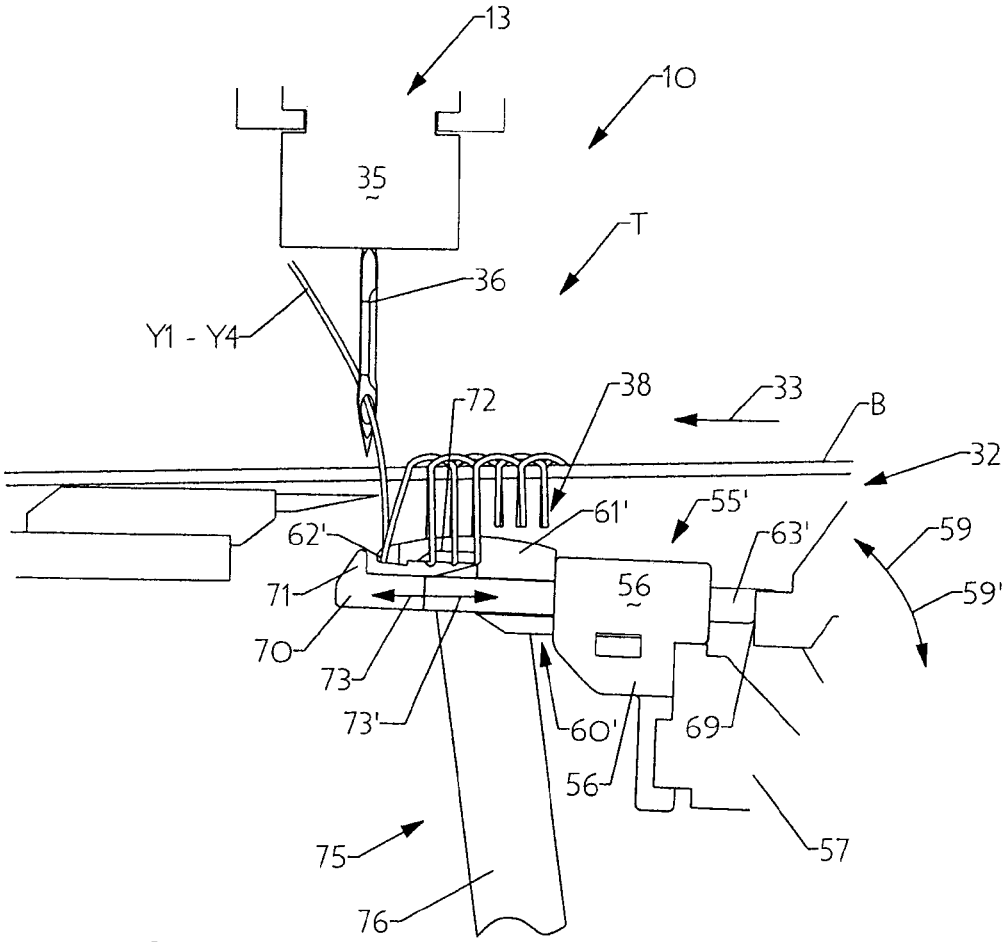
Figure 5C:
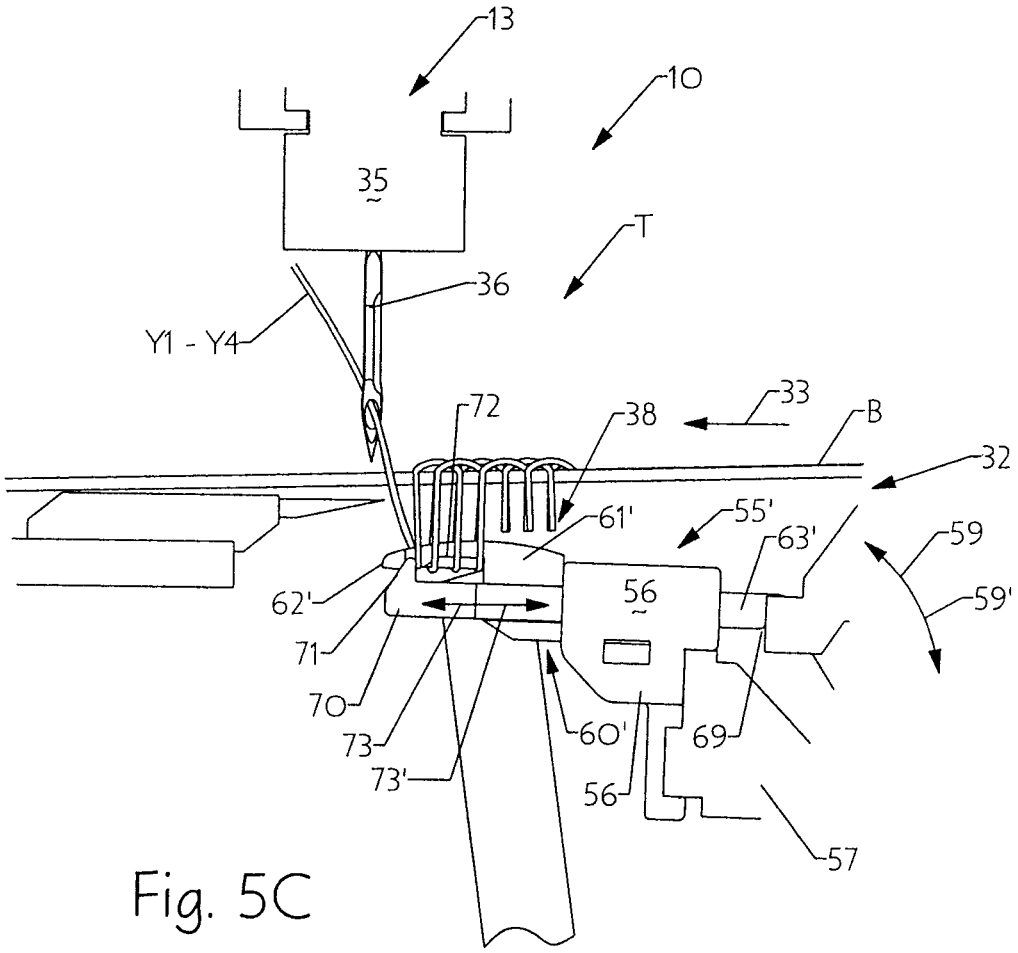

In an alternate embodiment, as indicated in FIGS. 5A-5C, the looper body 60' of each level cut looper 55' can include a slot or passage formed therealong for receipt of a clip 63' associated with each level cut loop looper. In this embodiment, each of the clips 63' generally will include an elongated body with a first or rear end 69 that attaches to a gate or connector for mounting to an output or draft shaft of an associated with actuator 66 (FIG. 3), and a forwardly extending, substantially L-shaped upturned front end 70 having a vertically extended or upstanding bearing portion or face 71 formed at the tip thereof. This bearing portion or face 71 generally is adapted to engage and bear/rest against a flattened portion or rest area 72 formed along the side edge of the front bill portion 62' of its associated level cut loop looper 55'. As indicated in FIGS. 5A-5C, in this embodiment, the front bill portions 62' of the level cut loop loopers 55' generally will be formed with a longitudinally extending, substantially pointed configuration, rather than being a hooked front end as in the embodiment illustrated in FIGS. 3-4B. The clips 63' are further slideable along the channels formed in the body portions 60' of the level cut loop loopers 55' in the direction of arrows 73 and 73' under operation of the actuators engaged or associated therewith.

In operation, the clips 63' will be moved forwardly or downwardly by operation of their associated actuators to move the clips from a recessed position shown in FIG. 5A, bearing against the flat or rest portion 72 formed along the side surface of the front bill portion 62' of the level cut loop looper 55', to an extended position, illustrated in FIG. 5B, projecting forwardly from the tip or front end of the bill 62'. When the clips are in their retracted positions (FIG. 5A), as level cut loop loopers reciprocate forwardly in the direction of arrow 59, the yarns are engaged by the level cut loop loopers 55', and loops of yarns are picked from the needles and are retained on the front ends of the bills 62' of the level cut loop loopers, in front of the upturned front end 70 of each clip 63', as illustrated in FIG. 5A. These loops of yarn thereafter can be pulled from the front ends or bills 62' of the level cut loop loopers 55' by the return stroke or reciprocation of the level cut loop loopers in the direction of arrow 59', without the clips engaging or interfering with the pick up of the yarns from the needles. As a result, loop pile tufts can be formed in the backing material while the clips 63' are in their retracted positions.

Alternatively, to form cut pile tufts, the actuators for the selected level cut loop loopers 55' will be engaged as to move their clips 63' forwardly, as indicated in FIG. 5B, so as to create a gap or space between the front end or tip of the front bill portion 62' of the level cut loop looper 55' and the upturned bearing portion or face 71 of its clip 63'. The bearing portion 71 of each clip 63' thus is moved forwardly and into a position to avoid engagement or interference with the pick-up of the yarns from the needles by the front bill portions of the level cut loop loopers, as indicated in FIGS. 5B and 5C. After the yarns have been picked from their associated needles, the clips 63' of the selected level cut loop loopers can be retracted, the same time the level cut loop loopers are being reciprocated rearwardly in the direction of arrow 59' on a return stroke. As a result, as indicated in FIG. 5C, the loops of yarns picked from the needles are trapped and move along the throat portions of the level cut loop loopers so as to be retained thereon for cutting to selectively form cut pile tufts in the backing material.

As further illustrated in FIGS. 3 and 5B-5C, a series of knife assemblies 75 typically are provided adjacent the level cut loopers 55 of the hook or looper/hook assembly 32. Each knife assembly 75 generally includes a knife or cutting blade 76 mounted within the holder 77 (FIG. 3) connected to a reciprocating drive mechanism 78. The knives are reciprocated into engagement with the level cut loopers 55/55' (FIGS. 3 and 5C) so as to cut any loops of yarns selectively captured thereon in order to form the cut pile tufts 38 in the backing material as the backing material B is passed through the tufting zone in the direction of arrow 33, as indicated in FIG. 3.

Figure 9A:
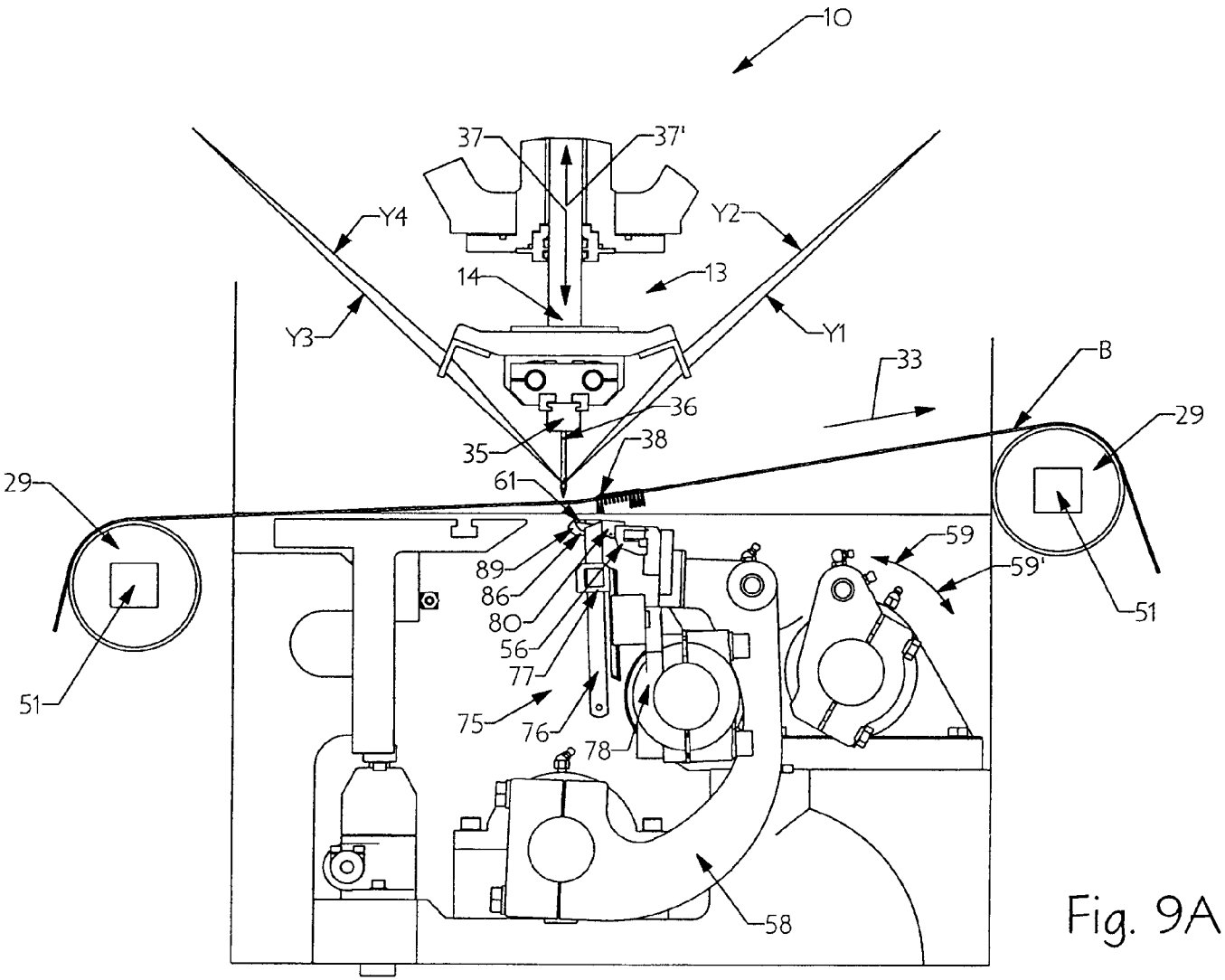
FIG. 9A is a side elevational view of another embodiment of a tufting machine incorporating the stitch distribution control system of the present invention illustrating the use of cut/loop hooks.
Figure 9C:
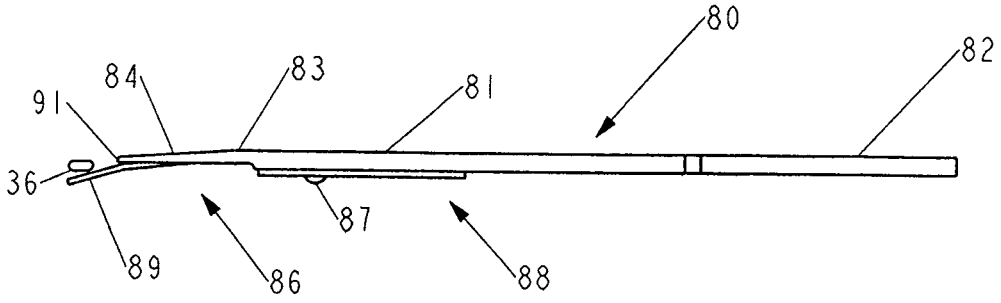
FIG. 9C is a plan view of the cut/loop hook of FIG. 9B.
Figure 9B:
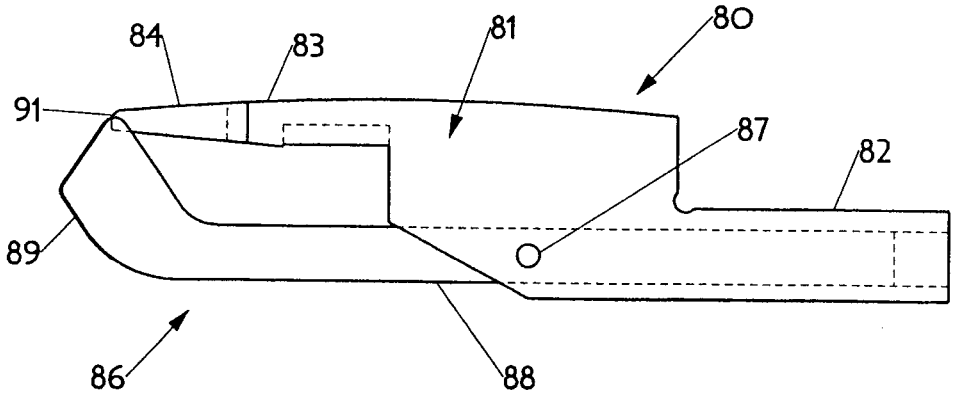
FIG. 9B is a side view of a cut/loop hook as used in the tufting machine of FIG. 9A.

As shown in FIG. 9A, in still another alternative embodiment of the stitch distribution control system according to the principles of the present invention, the hook/looper assembly 32 of the tufting machine 10 can include a series of cut/loop hooks 80. Each cut/loop hook 80 (FIGS. 9B-9C) generally will include an elongated body 81 having a shank 82 received within a slot of a hook bar 56, and a throat portion 83 terminating in a pointed end or bill 84. A clip 86, generally formed from a resilient, flexible material such as a spring steel, can be attached, such as by a rivet or other means 87 to the body 81 of the cut/loop hook 80 as indicated in FIG. 9B. The clip includes a rear or shank portion 88 extending along the shank 82 of the cut/loop hook body, and a front body or engaging portion 89 biased into bearing contact with the bill 84 of the cut/loop hook at a tip or bearing portion 91. As the cut/loop hook engages a needle 36 (FIGS. 9A and 9C), the bill of the cut/loop hook picks a loop of yarn therefrom. As the cut/loop hook reciprocates forwardly, the loop is pulled past the bearing portion of the clip so as to be retained thereon for cutting by an associated knife assembly 71. Alternatively, the yarn feed mechanism can be controlled to selectively pull loops of yarns tight, sufficient to pull the selected loops of yarns off of the cut/loop hook prior to engagement by its knife assembly to form a loop pile tuft.

Figure 10A:
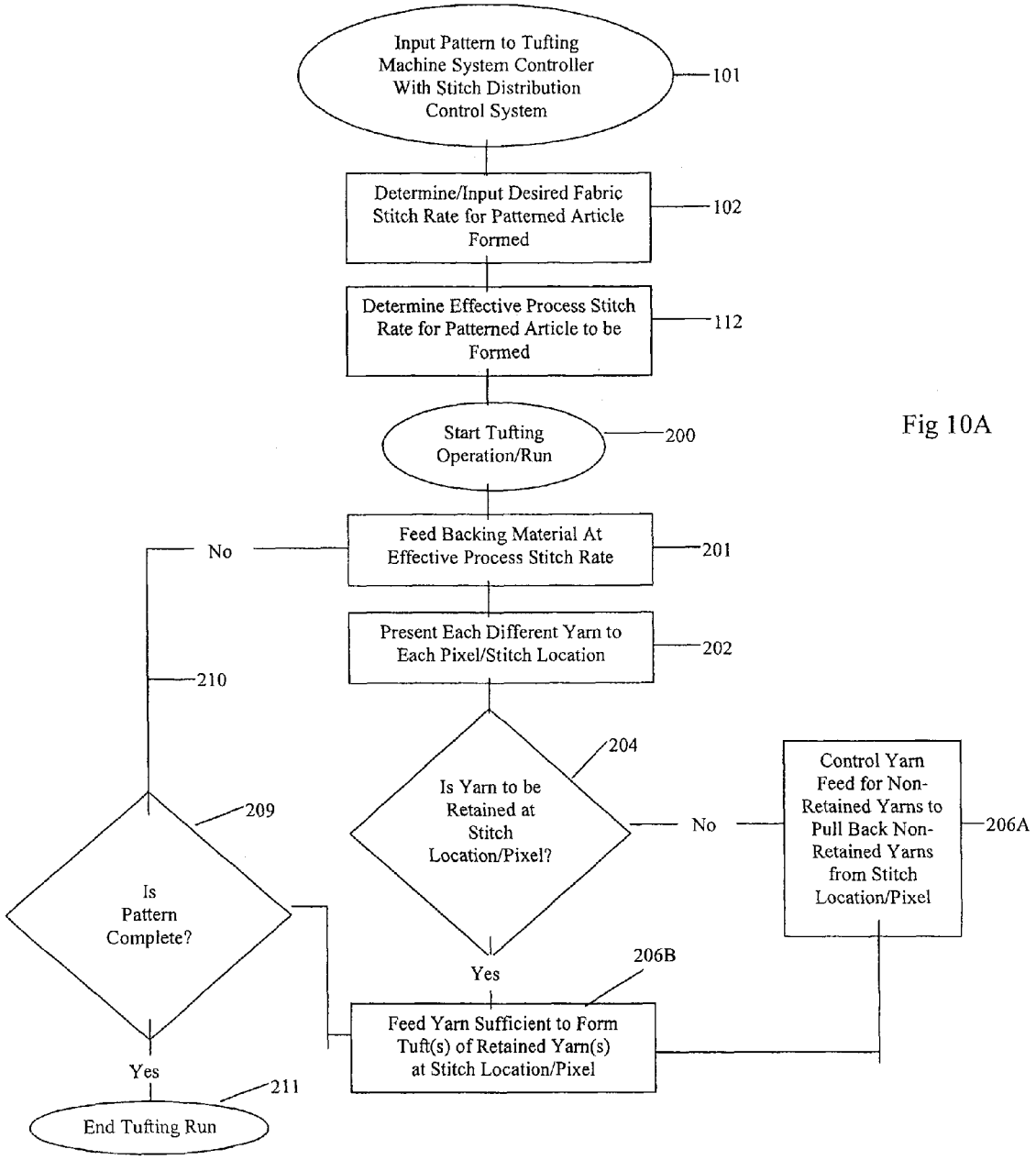
FIGS. 10A-10C are flow diagrams illustrating the operation of the stitch distribution control system according to the principles of the present invention.
Figure 10B:
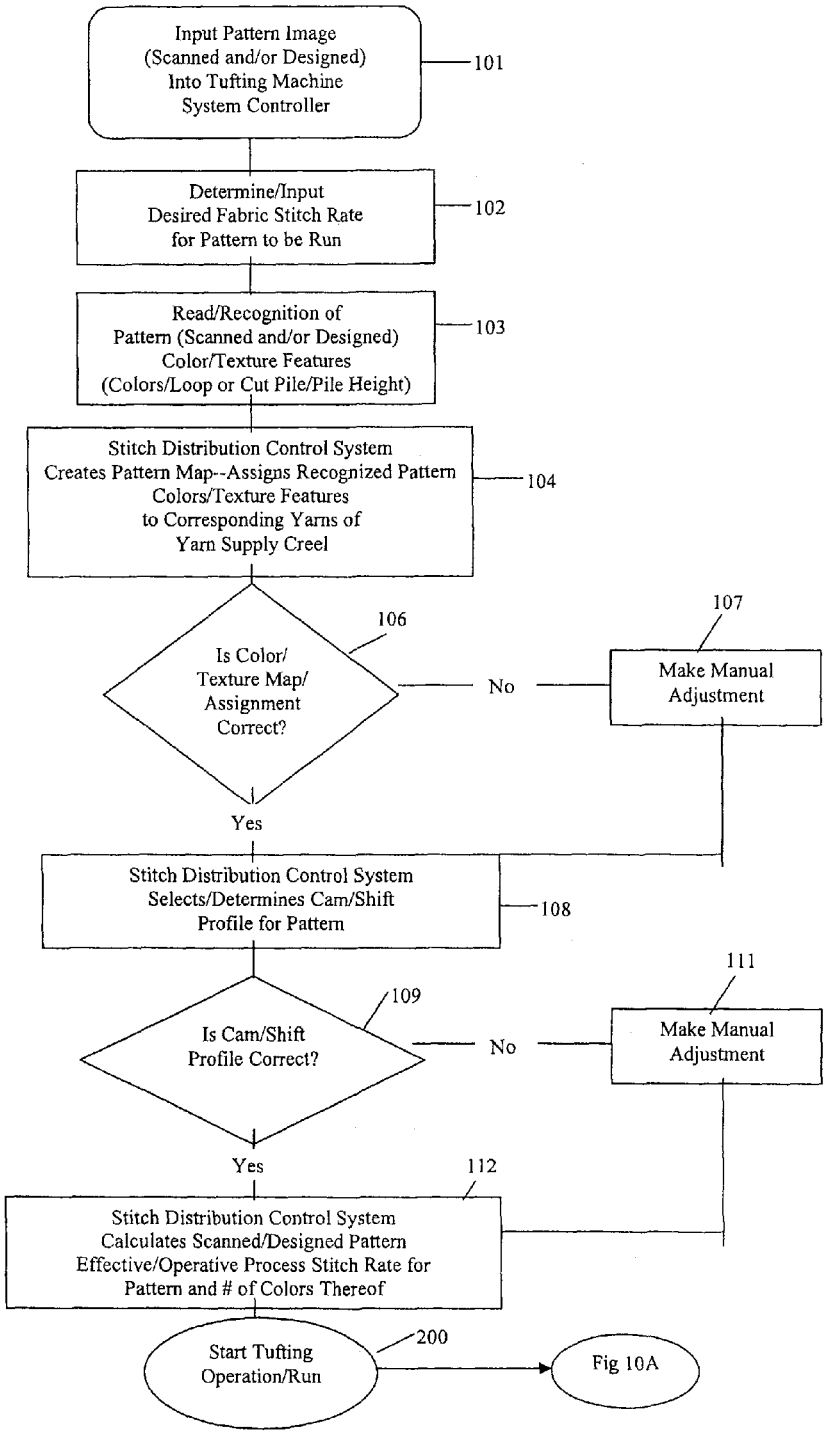

FIGS. 10A-10B generally illustrate example embodiments/variations of the operation of the stitch distribution control system according to the principles of the present invention. As an initial step 100 shown in FIG. 10A, an operator can input a pattern image/design into the system controller of the tufting machine operating the stitch distribution control system according to the present invention. The pattern image/design can be calculated manually or at a design center and input manually, it can be input by scanning or downloading an image file, such as simply by scanning a photograph, a drawing, or other pattern image/design using a scanner or other imaging/input device 31 (FIG. 1) located at or near the tufting machine 10 and linked to the system controller 26, or it can be input by loading the image from a disk drive or via network connection into the system controller and creating a jpeg, tiff, bitmap, or other machine readable image file. Based on the scanned/input pattern image, the stitch distribution control system also will include image recognition software designed to enable the pattern image to be read and processed for calculation/determination of the pattern parameters and steps for the operation of the tufting machine to form the desired pattern.

As indicated at 101, the stitch distribution control system further can automatically calculate or determine the desired fabric stitch rate or density for the pattern, i.e., based upon the gauge of the machine, such as ten stitches per inch for a tenth gauge machine, eight stitches per inch for an eighth gauge machine, etc., and/or can receive input from an operator as to a calculated desired fabric stitch rate or density for the finished pattern appearance (i.e., 8-12 stitches per square inch of the fabric shown on the face of the finished tufted article). Once the pattern and the desired fabric stitch rate for the article to be tufted have been input or determined/selected by the system controller, as noted at 102 in FIG. 10A, the stitch distribution control system also can read and recognize scanned and/or designed pattern image colors and/or texture features such as variations in colors, whether loop or cut pile tufts are being formed, differences in pile heights, etc., for determining additional pattern parameters such as the yarn feed control steps, as indicated at 103 in FIG. 10B. The operator additionally can be queried as to the number of colors and/or other pattern or textured effects, such as pile height differences, etc., to be run in the scanned and/or designed pattern.

Upon receiving or reading the scanned and/or designed pattern image design or texture features, the stitch distribution control system of the present invention generally will create a pattern map or field including a series of pattern pixels or tuft/stitch locations at which one or more tufts of yarns or stitches will be placed, as indicated at 104 in FIG. 10B. Each pattern pixel or stitch location generally will be defined by the gauge of the machine (i.e., eighth gauge, tenth gauge, etc.,) and by a desired density, for example, a desired number of retained stitches per inch, and accordingly the pattern weight, of the finished tufted article. For example, for a tenth gauge machine, wherein the needles are spaced $1/10^{th}$ of an inch apart, and a desired stitch rate or pattern density of ten stitches per inch, each pattern pixel or tuft location can occupy a space of approximately one-tenth of an inch times one-tenth of a inch, or approximately $1/100$th of a square inch in the face of the backing material. The size of the pattern pixels or stitch locations further can be varied depending upon adjustments made to the pattern density desired by the operator. For example, if the operator desires an increased density of approximately twelve stitches per inch on the same tenth gauge machine, each pixel can occupy a space or location of the approximately $1/120^{th}$ of a square inch in the backing material. Each yarn or stitch may be mapped and matched to a desired pattern pixel or stitch location, with the pattern pixels or stitch locations potentially including more than one tuft inserted therein for mixing of various colors, providing a further density or tweed effect as well. As noted further below, the stitch distribution system further will calculate an operative or effective stitch process rate to ensure that every color that could be tufted or sewn at a desired tuft/stitch location or pattern pixel generally will be presented to each pixel pattern or stitch location for selection of the desired color.

The stitch distribution control system thereafter will assign recognized pattern colors to corresponding yarns of the yarn supply creel. The assignment of the yarns in the creel based upon the recognized colors of a pattern generally will be selected in order to optimize the existing yarn supplies in the creel. The stitch distribution control system further can generate and display a table or color mapping of the pattern showing the assignment of the particular color yarns in the creel. As also indicated at 106 in FIG. 10B, the operator can be queried as to whether the color mapping or assignment or texture mapping is correct. If not, the operator can be permitted to make a manual adjustment via a manual override control or program, as indicated at 107A.

As a next step 108, once the color and/or texture assignment is correct, the stitch distribution control system then can select or determine a cam or shift profile for the pattern. The cam or shift profile can be calculated by the stitch distribution control system, or can be selected from a series of pre-programmed cam profiles in order to match the shift steps to the desired pattern in view of the other calculated pattern parameters. Again, the operator can be queried (108) to determine if the cam/shift profile is correct. If not, the operator can, via the manual override, adjust or modify the shift profile as needed, as shown at 111. Additionally, the stitch distribution control system of the present invention will also calculate an operative or effective process stitch rate for the pattern, as indicated at 112 in FIGS. 10A-10B. As discussed above, this effective or operative process stitch rate typically is substantially higher than a fabric conventional stitch rate, which is generally based on machine gauge, though an operator can adjust it as needed to get a desired density fabric weight. With the present invention, if, for example, an operator wants the pattern to have the appearance of a desired number, i.e., 8, 10, 12, etc., of stitches per inch, the desired/conventional fabric stitch rate or density for the tufted article can be increased by a factor approximately equivalent to the number of colors being tufted, for example, i.e., 2, 3, 4, 5, etc., colors so as to create an increased operative or effective process stitch rate of 16, 24, 30, 40, 60 or higher in order to provide sufficient increased density in the appearance and/or retained stitches per square inch for the tufts being formed in the pattern fields so as to hide those yarns that are not to be retained or shown.

Figure 10C:
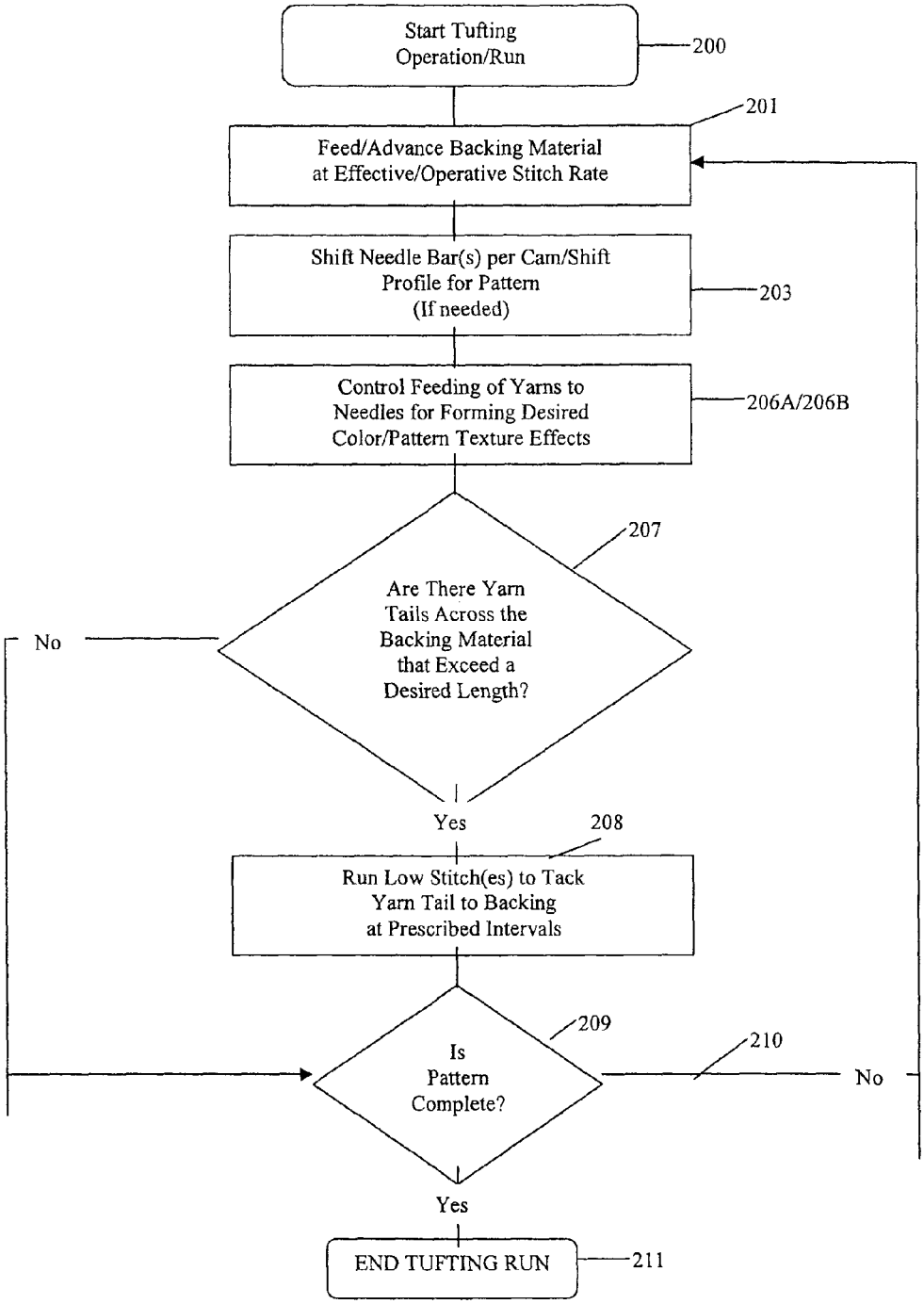

Thereafter, with the pattern parameters determined/calculated, the tufting operation can be started as indicated at 200 in FIGS. 10A and 10C. As the pattern is sewn, the backing material B (FIGS. 2B and 3) is fed or advanced through the tufting zone T at the prescribed effective or operative process stitch rate as noted at 201 in FIGS. 10A and 10C. The feeding or advancement of the backing material can be controlled by the stitch distribution control system in a variety of ways, including running a series of straight stitches or cycles of the needle bar(s) with no movement of the backing material, or running a pre-determined number of stitches and moving the material incrementally per stitch. For example, for a tenth gauge machine running four colors, the backing material can be moved one-fortieth (1/40") of an inch per each stitch, or alternatively, the stitch distribution control system can control the tufting machine to run four stitches and then move the backing material incrementally by approximately one-tenth (1/10") of an inch. Alternatively, the number of stitches per cycle of the needle bar can be further manipulated, such as by the manual override function to manipulate/vary the movement of the backing material on a stitch-by-stitch basis, with the average movement of all the stitches over a cycle substantially matching the calculated incremental movement at the effective stitch rate, i.e., for a 4-color cycle such as shown in FIG. 7B, one stitch can be run at $1/80^{th}$ of an inch, the next two at $1/40^{th}$ of an inch, and the fourth at $1/20^{th}$ of an inch, with the average incremental movement of the backing over the entire 4-stitch cycle averaging $1/40^{th}$ of an inch, as needed, to achieve a desired stitch/color placement.

As shown at 202 in FIG. 10A, each different yarn/color yarn that can be tufted at a particular stitch location or pixel will be presented to such stitch locations or pixels as the pattern is formed in the backing material. To accomplish such presentation of yarns at each pixel or stitch location, the needle bars generally can be shifted as needed/desired per the calculated or selected cam profile or shift profile of the pattern to be run/formed as indicated at 203 in FIG. 10C. For example, as indicated in FIGS. 6A-7D, the needle bar will be shifted using a combination of single and/or double jumps or shifts, based on the number of colors being run in the pattern and the area of the pattern field being formed by each specific color. Such a combination of single and double shift jumps or steps will be utilized in order to avoid over-tufting or engaging previously sewn tufts as the needle bar is shifted transversely and the backing material is advanced at its effective or operative stitch rate. The backing also can be shifted by backing or jute shifters, etc., either in conjunction with or separately from the needle bar shifting mechanism. Additionally, as the needles penetrate the backing material, the gauge parts such as loop pile loopers 50 (FIGS. 2A-2C), cut pile hooks and/or level cut loop loopers 55 (FIG. 3) of the looper/hook assembly 32 (FIGS. 1-5) positioned below the tufting zone T, also are reciprocated toward the tufting zone so as to engage and pick or pull loops of yarns from each of the needles.

Further, where level cut loop loopers are utilized, as illustrated in FIGS. 3-4, as the level cut loop loopers are being moved into engagement with the needles, they can be selectively actuated, as needed to form loops of yarns, that either will be released from the level cut loop loopers, or retained thereon for forming cut pile tufts. The level cut loop loopers each will be individually controlled by the color distribution control system so as to be selectively fired as needed, according to the movement of the stepping or shifting needle bar. As a result, for each step or shift of the needle bar according to the pattern, each level cut looper actuator will be controlled individually so as to selectively engage or retract its clip to enable selected loops of yarns to be picked from the needles by the level cut loop loopers and held for cutting, thus forming cut pile tufts. In their extended positions, the clips will cause the loops of yarns engaged by the level cut loop loopers to be released to form either loop pile tufts, or which will be pulled low or back-robbed by operation of the pattern yarn feed attachment controlling the feeding of such yarns, to hide or bury the non-selected ends of these yarns within a particular color field being formed according to the pattern instructions.

As the needles are retracted from the backing material during their reciprocal movement in the direction of arrow 37' (FIG. 3), the feeding of the yarns by the pattern yarn feed attachments or yarn feed mechanisms 27/28 (FIG. 1) also will be controlled as indicated by 204-206A in FIG. 10A. As indicated at 204, the system can determine which yarn/color of yarn being presented at each pixel or stitch location is to be retained at that particular pixel or stitch location. Generally, when a needle or yarn is presented to a pixel or stitch location, the yarn feed for such needle will be controlled to retain that yarn at that pixel or stitch location, and if the yarn is not to be appearing, it is not retained at the pixel or stitch location. As indicated at 206A in FIG. 10A, the feeding of the yarns of the non-selected or non-appearing colors (i.e., the colors that are to be hidden and thus not visible in the particular color fields of the pattern being sewn at that step) will be controlled so that these yarns will be back-robbed or pulled low, or even pulled out of the backing material by the yarn feed mechanisms feeding each of these yarns so as to float on the backing material. For the retained yarns/colors, i.e., the yarns appearing on the face of the patterned tufted article, as shown at 206B in FIG. 10A, the yarn feed mechanisms feeding on these yarns are controlled so as to feed an amount of yarn sufficient to form tufts of a desired type and pile height. The effective or operative process stitch rate being run by the color distribution control system of the present invention further provides for a denser field of stitches or tufts, so that the yarns being pulled low and/or backrobbed or removed are effectively hidden by the remaining cut and/or loop pile tufts formed in the backing material. Additionally, the stitch distribution control system can perform yarn feed compensation and/or modeling of the yarn feed to help control and reduce the amount of non-retained or non-appearing yarns that may be "floating" on the back side of the backing material to further help reduce/minimize excess yarn feed and/or waste.

In general, for each pattern pixel or tuft location being sewn or tufted, each of the colors that could be tufted at that location, which could include all of the colors of the pattern, only selected ones of the colors of the pattern, or even none of the colors, will be presented to the looper or hook associated with sewing or forming a tuft in that selected pattern pixel or tuft location. Thus, with a five color pattern, for example, all five colors can be presented to a desired looper, such as indicated in FIG. 7C, or a lesser number, i.e., 1, 2, 3, or even 0, colors can be presented. The stitch distribution control system will control the yarn feed mechanism(s) for the various color yarns presented to each looper, to control which yarn will remain in the desired tuft location or pattern pixel in the backing so as to be visually seen in the finished tufted article, while the remaining yarns(s) presented to the looper or hook will be pulled low or back robbed completely from the backing material so as to float on the rear surface of the backing material and thus to hide those tufts from view. At the same time, the backing material generally will be moved by an optional, variable amount according to the operative or effective process stitch rate, such as, for example, in a tenth gauge machine running 4 colors, moving one-tenth of an inch, one-fortieth of an inch or even not moving at all, in order to achieve the desired pattern density selected by the operator. Thus, where an operator selects ten to twelve stitches per inch as a desired pattern density or stitch rate, the stitch distribution control system of the present invention may actually run twenty to forty-eight or more stitches per inch, even though visually, from the face of the finished tufted article, only ten to twelve stitches will appear.

Accordingly, across the width of the tufting machine, the stitch distribution system will control the shifting and feeding of the yarns of each color or desired pattern texture effect so that each color that can or may be sewn at a particular tuft location or pattern pixel will be presented within that pattern pixel space or tuft location for sewing, but only the selected yarn tufts for a particular color or pattern texture effect will remain in that tuft/stitch location or pattern pixel. As further noted, it is also possible to present additional or more colors to each of the loopers during a tufting step in order to form mixed color tufts or to provide a tweed effect as desired, wherein two or more stitches or yarn will be placed at desire pattern pixel or tuft location. The results of the operation of the stitch distribution control system accordingly provide a multi-color visual effect of pattern color or texture effects that are selectively placed in order to get the desired density and pattern appearance for the finished tufted article. This further enables the creation of a wider variety of geometric, free flowing and other pattern effects by control of the placement of the tufts or yarns at selected pattern pixels or tuft locations.

Still further, as indicated at 207 in FIG. 10C, in instances where, for example, a large color field, is being formed in the pattern wherein one or more non-appearing yarns of other colors (i.e., colors that will not be shown in the particular color field being tufted) would form extended length tails or back stitches across the backing material, the system controller running the stitch distribution control system of the present invention can control the yarn feed mechanisms to automatically run sufficient yarns to selectively form one or more low stitches as in the backing material, as opposed to completely back-robbing the non-appearing yarns from the backing material. Thus, the non-appearing yarns can be tacked or otherwise secured to the backing material, as noted at 208 in FIG. 10C to prevent the formation of such extended length tails that can later become caught or cause other defects in the finished tufted article. The stitch distribution control system can be programmed/set to tack or form low stitches of such non-appearing yarns at desired intervals, for example every 1 inch to 1.5 inches, although greater or lesser intervals also can be used. Yarn compensation also generally will be used to help ensure that a sufficient amount of yarns are fed when needed to enable the non-appearing yarns to be tacked into the backing material, while preventing the yarns from showing or bubbling up through another color, i.e., with the yarns being tacked into and projecting through one of the stitch yarns with several yarns being placed together. Additionally, where extended lengths or tails would be formed for multiple non-appearing yarns, the intervals at which such different yarns are tacked within the backing material can be varied (i.e., one at 1", another at 1.5", etc.,) so as to avoid such tacked yarns interfering with one another and/or the yarns of the color field being formed.

The control of the yarn feed by the yarn feed pattern attachments feeding of yarns of a variety of different colors to the needles, in conjunction with the operation of each shift mechanism and level cut loop loopers or hooks, cut pile hooks, loop pile loopers and/or cut/loop hooks, and with the backing material being run at an operative or effective process stitch rate that is substantially increased or denser than fabric stitch rates solely based upon gauge of the machine enables the stitch distribution control system of the present invention to provide for a greater variety of free-flowing patterns and/or patterns with a loom-formed appearance to be formed in the backing material. As further indicated at 209-211 in FIGS. 10A and 10C, the pattern tufting operation being run by the stitch distribution control system continues, and can be repeated (210), for each stitch of the pattern until the pattern is complete (211). Additionally, the yarn feed also can be controlled to provide other desired pattern effects, such as forming varying pile heights or other effects. For example, where cut/loop hooks are used as shown in FIG. 9A, the yarn feed can be selectively controlled to pull certain loops of yarns off of their cut/loop clips to form loop pile tufts, or can feed sufficient yarn to allow certain loops to be retained on the cut/loop hooks for cutting to form cut pile tufts.

Accordingly, the stitch distribution control system of the present invention can enable an operator to develop and run a variety of tufted patterns having a variety of looks, textures, etc., at the tufting machine without necessarily having to utilize a design center to draw out and create the pattern. Instead, with the present invention, in addition to and/or as an alternative to manually preparing patterns or using a design center, the operator can scan an image (i.e., a photograph, drawing, jpeg, etc.,) or upload a designed pattern file at the tufting machine and the stitch distribution control system can read the image and develop the program steps or parameters to thereafter control the tufting machine substantially without further operator input or control necessarily required to form the desired tufted patterned article.

It will be understood by those skilled in the art that while the present invention has been discussed above with reference to particular embodiments, various modifications, additions and changes can be made to the present invention without departing from the spirit and scope of the present invention.

What is claimed:

1. A method of operating a tufting machine to form a patterned article including a plurality of different color yarns and having a desired stitch rate, comprising:

receiving a pattern including a series of pattern steps for forming the patterned article;

determining an increased stitch rate for the patterned article based upon the desired stitch rate for the patterned article, with the increased stitch rate being greater than the desired stitch rate;

feeding a backing material through the tufting machine at the increased stitch rate;

as the backing material is fed through the tufting machine, for at least a majority of stitches of the pattern being formed, reciprocating a series of needles to deliver a series of the different color yarns into the backing material sufficient to form a number of tufts of yarns approximately equivalent to the number of the different color yarns multiplied by the desired stitch rate; and controlling delivery of the yarns to the needles in accordance with programmed pattern instructions to selectively retain a tuft of a desired yarn of the series of different color yarns delivered into the backing material while removing other yarns of the series of yarns delivered into the backing material for each stitch being formed in the backing material as the backing material is fed through the tufting machine at the increased stitch rate.

2. The method of claim 1 and wherein receiving a pattern comprises inputting an image, photograph, drawing, or design with an imaging device.

3. The method of claim 1 and wherein receiving a pattern comprises downloading or uploading an image file into a tufting machine controller for the tufting machine.

4. The method of claim 1 and wherein calculating a series of pattern steps comprises creating a pattern map including a series of pattern pixels each corresponding to a stitch location at which at least one tuft of yarn will be placed.

5. The method of claim 4 and wherein each pattern pixel is defined by a gauge of the tufting machine and a desired density of the pattern.

6. The method of claim 1 and further comprising determining a shift profile for the patterned article, and shifting the needles in accordance with the shift profile.

7. The method of claim 1 and further comprising varying movement of the backing material on a stitch-by-stitch basis.

8. The method of claim 1 and wherein controlling the feeding of the yarns further comprises selectively pulling back yarns as needed for forming cut and loop pile tufts in the backing material.

9. A method of forming a tufted pattern in a backing, the pattern having a desired stitch rate, the method comprising:

feeding a series of yarns to a series of spaced needles;

feeding the backing along a path of travel past the needles;

as the backing is fed through a tufting machine, reciprocating at least a portion of the needles carrying the yarns into and out of the backing to form a series of tufts in the backing; and at selected stitch locations of the pattern being formed in the backing, presenting a desired number of yarns for insertion into the backing and withholding non-selected yarns from remaining visible at the selected stitch locations;

wherein withholding the non-selected yarns comprises controlling the feeding of the non-selected yarns to the needles so as to pull such non-selected yarns substantially out of the backing; and wherein feeding the backing through the tufting machine comprises feeding the backing at an increased stitch rate approximately equivalent to the desired stitch rate increased by a selected multiple approximately based upon the desired number of yarns presented at each of the selected stitch locations to form the pattern.

10. The method of claim 9 and wherein presenting a desired number of yarns comprises shifting at least some of the needles carrying the yarns transversely with respect to the feeding of the backing.

11. A method of tufting a patterned article using a tufting machine having at least one needle bar with a plurality of needles spaced therealong, comprising:

threading at least a portion of the needles with a plurality of different color or type yarns in a selected sequence for forming a desired pattern having a desired stitch rate;

moving a backing through a tufting zone at an increased stitch rate approximately based upon the desired stitch rate multiplied by the number of the different color or type yarns of the selected sequence of yarns threaded onto the needles;

as the backing moves through the tufting zone, feeding the yarns to at least selected ones of the needles and reciprocating the needles so as to penetrate the backing and present a selected series of yarns to stitch locations in the backing; and at each stitch location of the stitch locations, controlling the feeding of the series of yarns presented at each said stitch location and selectively maintaining a desired yarn of the series of yarns presented at each said stitch location to form tufts of different color or type yarns based upon the pattern instructions, with one or more remaining yarns of the series of yarns presented being at least partially removed from the backing, and with the tufts of the different color or type yarns maintained at the stitch locations being formed with a number of tufts per inch approximately equivalent to the desired stitch rate.

12. The method of claim 11 and wherein selectively maintaining a desired yarn of the series of yarns presented comprises retaining none of the yarns presented.

13. The method of claim 11 and wherein selectively maintaining a desired yarn of the series of yarns presented comprises retaining one or more of the yarns presented.

14. The method of claim 11 and further comprising shifting at least some of the needles transversely with respect to the backing.

15. A method of operating a tufting machine, comprising:

receiving a pattern for forming a patterned article having visible tufts of different color or type yarns arranged with a density of tufts per inch approximately equivalent to a desired stitch rate for the pattern;

feeding a backing material through the tufting machine at an effective process stitch rate comprising a substantially greater number of stitches per inch than the desired stitch rate for the patterned article;

as the backing material is fed through the tufting machine at the effective stitch rate, at each stitch location of a plurality of stitch locations of the pattern, shifting at least one needle bar transversely with respect to the backing material and reciprocating a plurality of needles into and out of the backing material to present a series of the different color or type yarns into the backing material at the effective stitch rate sufficient to form tufts of each color or type yarn presented at each said stitch location; and controlling feeding of the yarns to the needles to selectively retain at least one visible tuft of a desired color or type yarn of the series of the different color or type yarns presented for each of the plurality of stitch locations being formed in the backing material while substantially removing other yarns of the series of different color or type yarns presented from the backing material as the backing material is fed through the tufting machine at the effective process stitch rate.

* * * * *